US007450072B2

(12) United States Patent
Kim et al.

(10) Patent No.: US 7,450,072 B2
(45) Date of Patent: Nov. 11, 2008

(54) MODIFIED INVERTED-F ANTENNA FOR WIRELESS COMMUNICATION

(75) Inventors: Je Woo Kim, San Jose, CA (US); Kyung Sup Han, San Ramon, CA (US); Volodymyr Rakytyanskyy, Santa Clara, CA (US); Oleksandr Sulima, Toronto (CA)

(73) Assignee: QUALCOMM Incorporated, San Diego, CA (US)

( * ) Notice: Subject to any disclaimer, the term of this patent is extended or adjusted under 35 U.S.C. 154(b) by 34 days.

(21) Appl. No.: 11/729,126

(22) Filed: Mar. 27, 2007

(65) Prior Publication Data

US 2007/0229366 A1 Oct. 4, 2007

Related U.S. Application Data

(60) Provisional application No. 60/786,896, filed on Mar. 28, 2006.

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/846, 876, 893

See application file for complete search history.

(56) References Cited

U.S. PATENT DOCUMENTS 6,268,831 B1 * 7/2001 Sanford ..... 343/702
7,183,980 B2 * 2/2007 Chang et al. ..... 343/700 MS
7,265,718 B2 * 9/2007 Tsai ..... 343/700 MS

* cited by examiner

*Primary Examiner*—Shih-Chao Chen
(74) *Attorney, Agent, or Firm*—Thomas Rouse; Ross L. Franks; Kenneth K. Vu

(57) ABSTRACT

An embodiment of the present invention is a modified inverted-F antenna for wireless communication. The antenna circuit includes a dielectric substrate having a first surface, a radiating stub on the first surface of the dielectric substrate, and a first ground plate on the first surface of the dielectric substrate to couple to ground. The first ground plate includes one or more grounded capacitive stubs spaced apart from the radiating stub. The one or more grounded capacitive stubs tune performance parameters for the antenna circuit.

30 Claims, 18 Drawing Sheets

MODIFIED INVERTED-F ANTENNA FOR WIRELESS COMMUNICATION

RELATED APPLICATION

This application claims the benefit of the provisional application, titled "Modified Inverted-F Antenna for Wireless Communication", filed Mar. 28, 2006, Ser. No. 60/786,896.

BACKGROUND

1. Field of the Invention

Embodiments of the invention relate generally to radio antennas for wireless communication systems. More particularly, the embodiments of the invention relate to low cost compact printed circuit board (PCB) antennas for subscriber units of wireless broadband communication systems and cellular wireless communication systems.

2. Description of Related Art

It is widely known that antennas can be used to transmit and receive electromagnetic radiation of certain frequencies to carry signals. That is, an antenna is typically designed to transmit and receive signals over a range of carrier frequencies. The antenna is a critical part of all wireless communications devices. Typically, antennas should meet very stringent requirements regarding size, efficiency, wide bandwidth of operation, ability to function efficiently when space is at premium and a low manufacturing cost. Small space, usually available for an antenna, dictates antenna choice, which may be a printed monopole antenna, an L-shaped antenna, a planar inverted-F antenna, a printed disc antenna or a patch antenna.

Small size of printed antennas, usually a quarter of operation wavelength, is the result of a ground plate effect utilized in the antenna design. Induced currents form a mirror image of a radiating element on the ground plate. Eventually the effective size of the antenna should include a part of the ground plate which includes significant part of induced currents. On the other hand, induced currents are very susceptible to any conducting elements placed in the neighborhood of the antenna. The commonly used approach to improve the performance of the printed antenna is to keep the antenna away from any conducting components of the device. The minimum distance between antenna and RF components, considered safe in the 3 GHz frequency band is equal to about of 1 cm. Violation of this rule results in a significant impedance mismatch between an antenna and a transmission line, efficiency loss and a resonant frequency shift.

Another factor, which significantly effects antenna performance, is the communications device plastic casing. Plastic casing significantly effects radiation efficiency of the antenna. Nevertheless, in an attempt to miniaturize a device, designers, practically, do not leave much space between a PCB and a plastic cover.

All factors, described above, make antenna design procedure extremely complicated and difficult. In each particular case, not only a PCB size and position of radio frequency (RF) components should be taken into account, but also devices plastic body shape and material dielectric constant. Other design criteria of an antenna may need to be considered, such as costs, portability, and possibly aesthetics. These design criteria are particularly relevant to portable wireless communication devices that are to be marketed to the general public. Moreover, the size or form factor of portable wireless communication devices poses particular challenges in antenna design. Additionally, consumers are demanding greater portability, higher data bandwidth, and better signal quality in wireless communication devices and systems.

BRIEF DESCRIPTION OF THE DRAWINGS

Embodiments of invention may best be understood by referring to the following description and accompanying drawings that are used to illustrate embodiments of the invention. In the drawings.

Figure 1A:
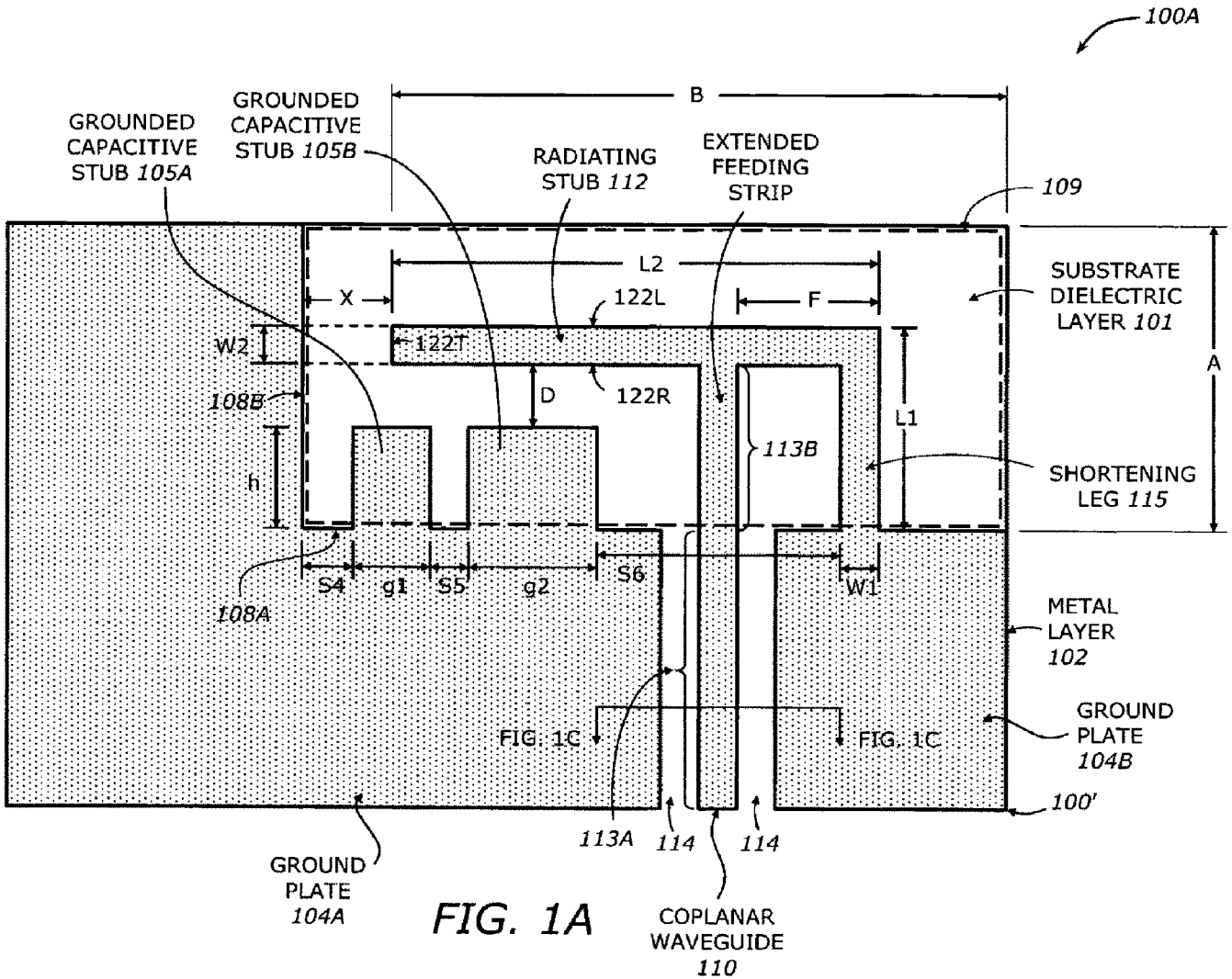
FIG. 1A is a top view of a first embodiment of a modified inverted-F antenna at a corner of a printed circuit board.

Like reference numbers and designations in the drawings indicate like elements providing similar functionality. Additionally, it is understood that all the drawings of figures provided herein are for illustrative purposes only and do not necessarily reflect the actual shape, size, or dimensions of the elements.

DESCRIPTION

An embodiment of the present invention is a modified inverted-F antenna for wireless communication. The modified inverted-F antenna includes a substrate, a radiating stub, one or more grounded capacitive stubs, a shortening leg, a ground plate on an outer layer of the substrate, an extended feeding strip, and a feeding transmission line. The feeding transmission line may be implemented as a microstrip line, a strip line, a coplanar waveguide (CPW), or a grounded coplanar waveguide (GCPW), and placed together with the extended feeding strip on the same outer layer or on different internal or other outer layer of a multilayer-substrate and connected to the radiating stub directly through the extended feeding strip for the same layer location or through the extended feeding strip and via hole for other layer locations. An internal and other outer substrate layers have no metal strips in any area of the modified inverted-F antenna excluding a layer with the extended feeding strip. The one or more grounded capacitive stubs tune performance parameters of the antenna.

In the following description, numerous specific details are set forth. However, it is understood that embodiments of the invention may be practiced without these specific details. In other instances, well-known circuits, structures, and techniques have not been shown to avoid obscuring the understanding of this description.

One embodiment of the invention may be described as a process which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a program, a procedure, a method of manufacturing or fabrication, etc.

Embodiments of the invention include a modified inverted-F antenna to radiate and/or receive wireless communication electromagnetic signals in a wireless communication system. In contrast to a base station (BS), the modified inverted-F antenna is designed for wireless communication subscriber stations (SS) that may be either fixed stations (FS) or mobile stations (MS). In a typical subscriber station, the dimensions and performance are at premium, due to the tightly packaged RF circuitry and the requirement for one or more antennas for switching diversity, Multiple Input Multiple Output (MIMO) or adaptive antenna array technology applications. Example applications with a small form factor include wireless adapters such as a CardBus, Personal Computer Memory Card International Association (PCMCIA), and USB-terminal adapters as well as laptop computers (e.g., printed inverted F antenna (PIFA) for MiniPCI SS), Cellular Phones, and personal digital assistants (PDA).

The modified inverted-F printed circuit board antenna has good matching and is designed for such applications where active RF circuitry and other structures are in close proximity. In a number of embodiments of the invention, the modified inverted-F antenna is formed in one or more corners of the printed circuit board. In a number of other embodiments of the invention, the modified inverted-F antenna is formed along an edge of the printed circuit board.

Each embodiment of the modified inverted-F antenna includes a feeding transmission line and an extended feeding strip that may be implemented in different ways. The feeding transmission line can be implemented as a microstrip line, a strip line, a coplanar waveguide (CPW) or a grounded coplanar waveguide (GCPW). The extended feeding strip is formed on the same layer as the feeding transmission line and coupled thereto. The type of the feeding transmission line selected has little-to-no influence on the performance of the modified inverted-F antenna. Instead, the type of the feeding transmission line chosen is based on how the overall RF PCB is designed, such as what layers of the PCB the signals from the amplifiers are available. In some embodiments of the invention, the feeding line, extended feeding strip, and radiating stub are on the same layer of a printed circuit board and can thereby be readily connected together. In other embodiments of the invention, the feeding line and extended feeding strip are on different layers from that of the radiating stub. In this case, the feeding line and extended feeding strip on one layer may couple to the radiating stub by way of a via (VIA), a hole with metallized walls.

Referring now to FIG. 1A, a top view of a first embodiment of a modified inverted-F antenna 100A is illustrated. The modified inverted-F antenna 100A is an integral part of a printed circuit board 100' including a substrate dielectric layer 101 and an outer conductive metal layer 102. The pattern in the outer conductive metal layer 102 over the substrate dielectric layer 101 generally forms the modified inverted-F antenna 100A in an area of a dielectric window 109 with dimensions A×B as illustrated. In one embodiment of the invention, the dimension of A is 9.4 millimeters and the dimension of B is 20.8 millimeters. The modified inverted-F antenna 100A is designed with multiple grounded capacitive stubs and a grounded coplanar waveguide feeding line on the same outer conductive metal layer 102 formed on the substrate dielectric layer 101. The dielectric window in the surface of the dielectric substrate is partially covered over by the pattern and the one or more grounded capacitive stubs. That is, the pattern and the one or more grounded capacitive stubs extend or encroach into the dielectric window 109.

The modified inverted-F antenna 100A includes the substrate dielectric layer 101, a radiating stub 112, one or more grounded capacitive stubs 105A-105B, a shortening leg 115, and one or more ground plates 104A-104B formed in the metal layer 102 on an outer layer of the substrate 101, as shown in FIG. 1A. The one or more ground plates 104A-104B are to couple to ground.

The radiating stub 112 has a first side edge 122R, a second side edge 122L, and a top edge 122T. The ground plate 104A is formed spaced apart along the first side edge 122R and the top edge 122T of the radiating stub 112.

The one or more grounded capacitive stubs 105A-105B extend from a first edge 108A of the ground plate 104A that is parallel with the first side edge 122R of the radiating stub. The height h of the one or more grounded capacitive stubs 105A-105B points toward the radiating stub. A second edge 108B of the ground plate 104A is substantially perpendicular to the first edge 108A. The second edge 108B of the ground plate 104A is substantially parallel with the top edge 122T of the radiating stub and spaced apart from it by the dimension X as illustrated in FIG. 1A.

The modified inverted-F antenna 100A further includes an extended feeding strip 113B as illustrated in FIG. 1A. In this case, the grounded coplanar waveguide (GCPW) 110 is the feeding transmission line.

The grounded coplanar waveguide (GCPW) 110 includes a central strip 113A bounded on left and right sides by the ground plates 104A-104B, each being separated by a gap 114. To complete the GCPW 110, the printed circuit board 100' has a ground plate 125 (shown in FIG. 1C) on a second metal layer 103 (shown in FIG. 1C) and under the central strip 113A and the gaps 114. The ground plate 125 is isolated from the central strip 113A by the dielectric layer of the substrate 101. The central strip 113A is coupled to the extended feeding strip 113B. The width of the central strip 113A and the gaps 114 are a function of the wavelength of the carrier frequencies of the wireless communication channels and the performance of the dielectric layers of the substrate 101.

The extended feeding strip 113B couples to the radiating stub 112 at one end and the central strip 113A at an opposite end. The shortening leg 115 is coupled to the ground plate 104B at one end and the radiating stub 112 at an opposite end. The length of the shortening leg 115 is chosen to provide a fifty (50) Ohm active input impedance for the antenna at the junction of the GCPW 110 to the extended feeding strip 113B. As the antenna presents itself as an inductive grounded stub, the input impedance of the antenna has some inductive reactance from the metal forming the radiating stub 112 and the shortening leg 115. Prior art attempts to reduce this inductive reactance, such as by narrowing a gap between the end of radiating stub and the ground plate and by bending the radiating stub toward the ground plate, have been largely unsuccessful due to their limited effect on antenna input impedance.

Figure 1B:
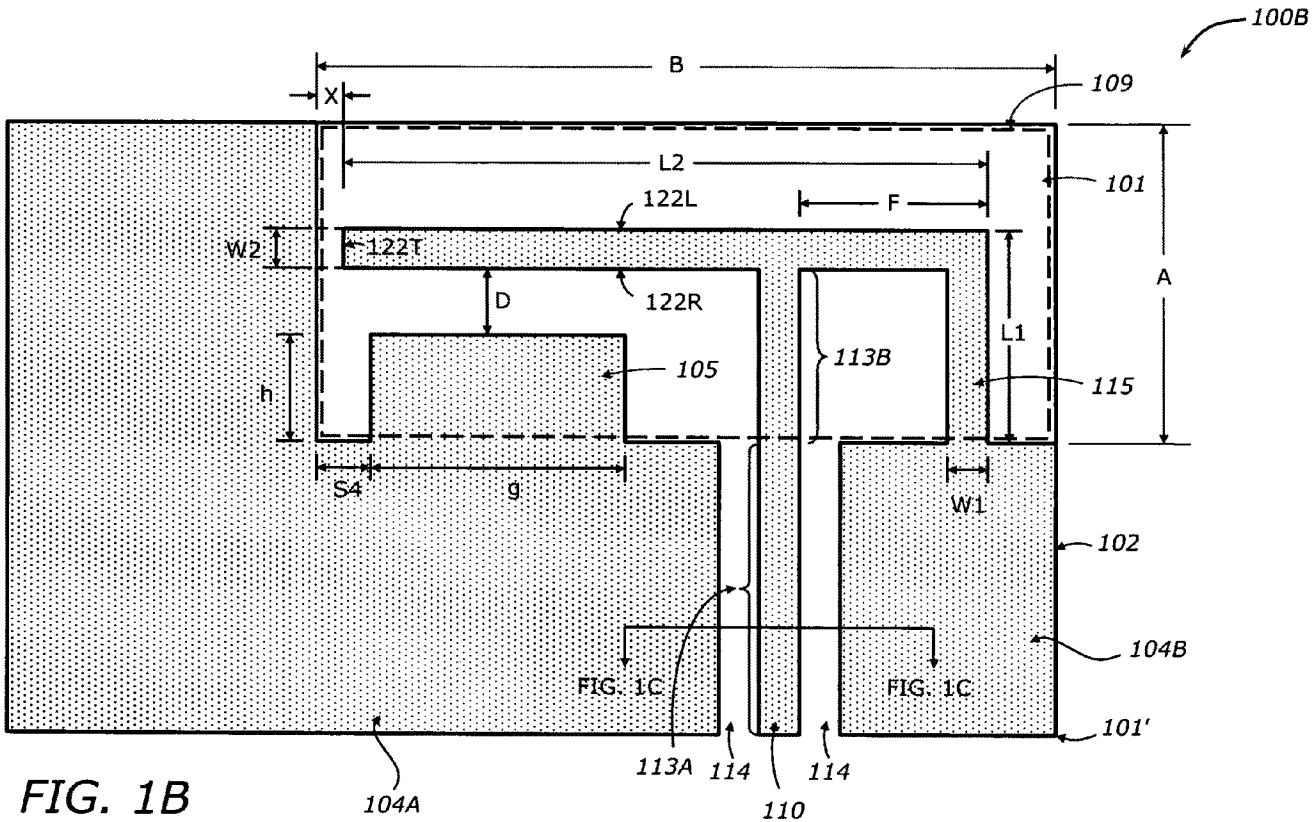
FIG. 1B is a top view of a second embodiment of a modified inverted-F antenna at a corner of a printed circuit board.
Figure 1C:
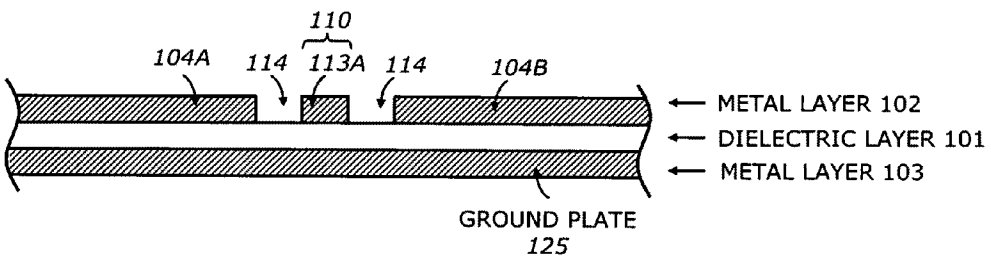
FIG. 1C is a cross-sectional view of the grounded coplanar waveguide illustrated in FIGS. 1A-1B.

Referring now to FIG. 1B, a top view of a second embodiment of a modified inverted-F antenna 100B is illustrated. The modified inverted-F antenna 100B has a feeding transmission line formed on the same outer layer of the substrate on which the antenna is formed.

The modified inverted-F antenna 100B is similar to the modified inverted-F antenna 100A but has only one grounded capacitive stub 105 having a width g and a space or gap S with ground plate 104A. In this exemplary embodiment, the edge 122R of the radiating stub 112 is parallel with the grounded capacitive stub 105 such that a top edge 122T of the radiating stub extends beyond the width g of the grounded capacitive stub 105 into the space S.

Otherwise, the modified inverted-F antenna 100B has similar elements to the modified inverted-F antenna 100A and uses similar reference numbers and nomenclature. Accordingly, the description of the elements of the modified inverted-F antenna 100B is not repeated for reasons of brevity, it being understood that the description of the elements of antenna 100A is equally applicable to the elements of antenna 100B.

Various dimensions for elements of the modified inverted-F antenna are shown in the drawings. The shortening leg 115 has a width W1 and length L1 as shown. The radiating stub 112 has a length L2 and a width W2 as shown. At a distance F up the radiating stub 112 from the shortening leg 115, the extended feeding strip 113B is coupled to the radiating stub 112 as shown. The positioning of the antenna in the dielectric window 109 along the A dimension is established by the length L1 of the shortening leg 115. The positioning of the antenna in the dielectric window 109 along the B dimension is established by the length L2 of the radiating stub and the dimensions S4, g1, S5, g2, S6, and W1 from the edge of the dielectric window.

From these or other dimensions, a space X may be formed between the top edge 122T of the radiating stub 112 and the ground plate 104A or edge of the dielectric window 109 in a number of embodiments of the invention.

The one or more grounded capacitive stubs 105, 105A-105B may each have a height h; a width g, g1, and g2; and a gap or spacing S, S4, S5. In some antenna designs, the gap or spacing S4 provides little positional information, in which case a gap or spacing S1 between the grounded capacitive stub 105B and the center strip 113A, or a gap or spacing S6 between the grounded capacitive stub 105B and the shortening leg 115, may be used to provide the positional information.

Knowing the height h of the grounded capacitive stubs, the length L1, and the width W2 of the radiating stub 112, the distance D between the one or more grounded capacitive stubs and the radiating stub 112 may be determined from the equation D=L1−W2−h. In addition to the dimensions h and D, a total effective length of the one or more grounded capacitive stubs (e.g., S4+S5+g1+g2; or S+g) along the edge of the ground plate and parallel with the length of the radiating stub 112 may be an important value in tuning the antenna.

In one exemplary embodiment of the modified inverted-F antenna 100A illustrated in FIG. 1A, a 3.5 GHz Antenna for a CardBus Worldwide Interoperability for Microwave Access (WiMAX) application, the dimensions are as follows:

A=9.4 mm; B=20.8 mm; L2=14.2 mm; F=4.4 mm; L1=5.1 mm; W1=W2=1.8 mm; S4=2.3 mm; S5=0.8 mm; g2=4 mm; g1=2.4 mm; and h=1.8 mm.

In this case, the substrate dielectric layer 101 is an FR-4 dielectric material with a dielectric thickness of 0.7 mm. Additionally, the feeding line has a fifty (50) Ohm impedance. That is, the microstrip line, coplanar waveguide, or grounded coplanar waveguide, whichever is selected, has dimensions calculated for the specific substrate, the FR-4 dielectric material with a thickness of 0.7 mm, so that it has a fifty (50) Ohm impedance.

In the exemplary embodiment shown in FIG. 1A, the top edge 122T of the radiating stub extends beyond the width g2 of the grounded capacitive stub 105B, the space S5 between the first and second grounded capacitive stubs, and up to a midpoint in the width g1 of the grounded capacitive stub 105A.

The radiating stub 112, the shortening leg 115, and the extended feeding strip 113B form the shape of an inverted-F in the metal layer 102, hence the name inverted-F antenna. The inverted-F antenna is used to transmit and receive electromagnetic radiation of certain frequencies to carry wireless communication signals.

The one or more grounded capacitive stubs 105, 105A-150B (See stubs 105A-105B in FIG. 1A and stub 105 in FIG. 1B) modify or tune the performance of the inverted-F antenna by acting as a tuning element to tune performance parameters of the antenna. The performance parameters include at least one of the reactance of the input impedance, low loss matching, ground plane effect, antenna radome, RF components effect, multiple mutual-coupling influence, antenna's resonant frequency, impedance matching between the antenna and the feeding line, gain magnitude, and antenna radiation pattern. Other parameters may also be tuned by the one or more grounded capacitive stubs 105, 105A-150B to improve performance of the antenna. The one or more grounded capacitive stubs 105, 105A-150B introduce a capacitive reactance that is transformed to input impedance of the antenna. The one or more grounded capacitive stubs 105, 105A-150B compensate the reactances of the input impedance of the antenna for (1) the intrinsic inductive reactance of its components, and (2) the external reactance that is induced by different external influences. The one or more grounded capacitive stubs 105, 105A-150B tune the performance of the inverted-F antenna in a lossless manner.

With the one or more grounded capacitive stubs acting as tuning elements, the antenna achieves good low-loss matching performance. The tuning provided by the one or more grounded capacitive stubs considers real design surroundings and compensates for a ground plane effect, a closely positioned antenna radome, an RF components effect, and a multiple antenna mutual-coupling influence on the antenna's resonant frequency.

The tuning provided to the inverted-F antenna may be adjusted by the number of one or more grounded capacitive stubs 105, 105A-150B that are used, as well as by the dimensions surrounding the grounded capacitive stubs 105, 105A-150B, including the previously described dimensions of the height h; the width g, g1, g2; the gap or spacing S, S4, S5; and the distance D.

Figure 9:
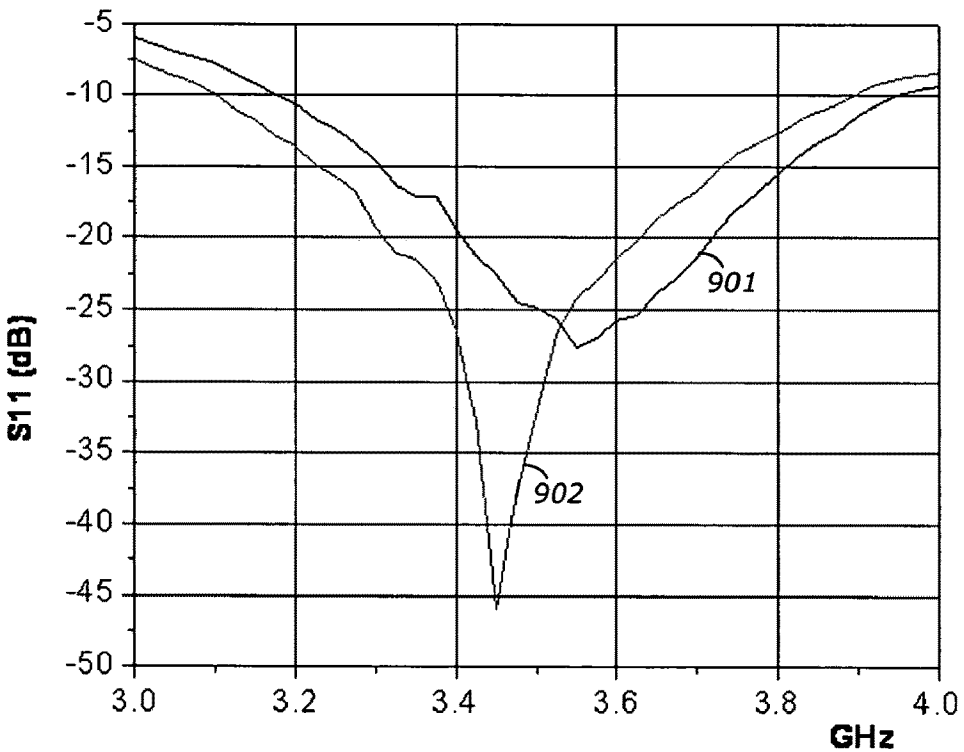
FIG. 9 illustrates a graph of the return loss of a modified inverted-F antenna for a CardBus printed circuit board such as illustrated in FIG. 5.
Figure 11:
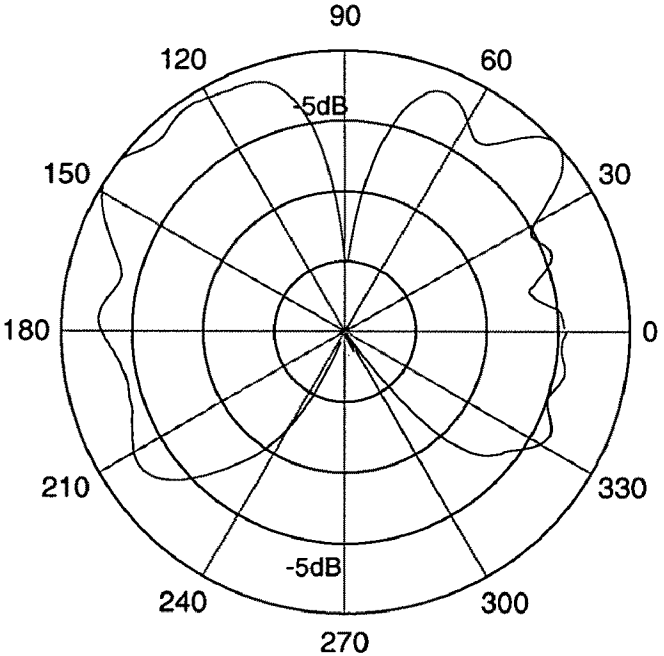
FIG. 11 illustrates a chart of the far field radiation pattern in a vertical plane for the CardBus modified inverted-F antenna shown in FIG. 5.
Figure 10:
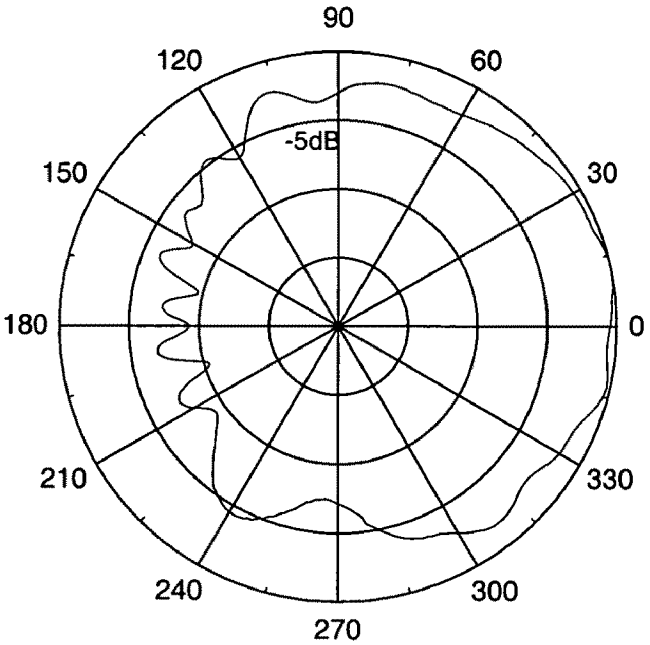
FIG. 10 illustrates a chart of the far field radiation pattern in a horizontal plane for the CardBus modified inverted-F antenna shown in FIG. 5.

The one or more grounded capacitive stubs 105, 105A-150B achieve a substantial impedance matching between the antenna and the chosen feeding line over a wide relative frequency band up to 22%. That is, one or more grounded capacitive stubs 105, 105A-150B provide substantial impedance matching in a frequency range of plus and minus 11% around the carrier frequency of the desired communication system. Moreover while the one or more grounded capacitive stubs 105, 105A-150B provide substantial impedance matching, they also substantially maximize the gain magnitude of the antenna without significantly influencing the antenna radiation pattern. FIGS. 9-11 described below illustrate the exemplary performance of a modified inverted-F antenna.

The 50 Ohm grounded coplanar waveguide (GCPW) 110, which includes the central strip 113A, and the extended feeding strip 113B allow signals to propagate to/from the radiating stub 112 of the antenna. Antenna impedance is substantially matched, by the one or multiple grounded capacitive stubs 105, 105A-150B, with 50 Ohm impedance of GCPW 110.

The 50 Ohm impedance of the grounded coplanar waveguide 110 is also matched by a 50 ohm impedance of active and passive RF circuitry, such as the antenna switch, signal filters, the input impedance of the low noise amplifier, and the output impedance of the power amplifier.

As described in greater detail below, a transmitting power amplifier may couple to the end of the GCPW 110 and amplify wireless signals for transmission out from the radiating stub 112. A receiving low noise amplifier (LNA) may couple to the end of the end of the GCPW 110 to amplify signals received by the radiating stub 112. As described in greater detail below, an antenna switch, an RF band-pass filter, or an RF low-pass Filter may be coupled between the antenna and the transmitting power amplifier and the low noise receiving amplifier to multiplex the use of the antenna for both transmitting and receiving signals as well selecting one of a plurality of antennas for transmitting and another for receiving.

Figure 2A:
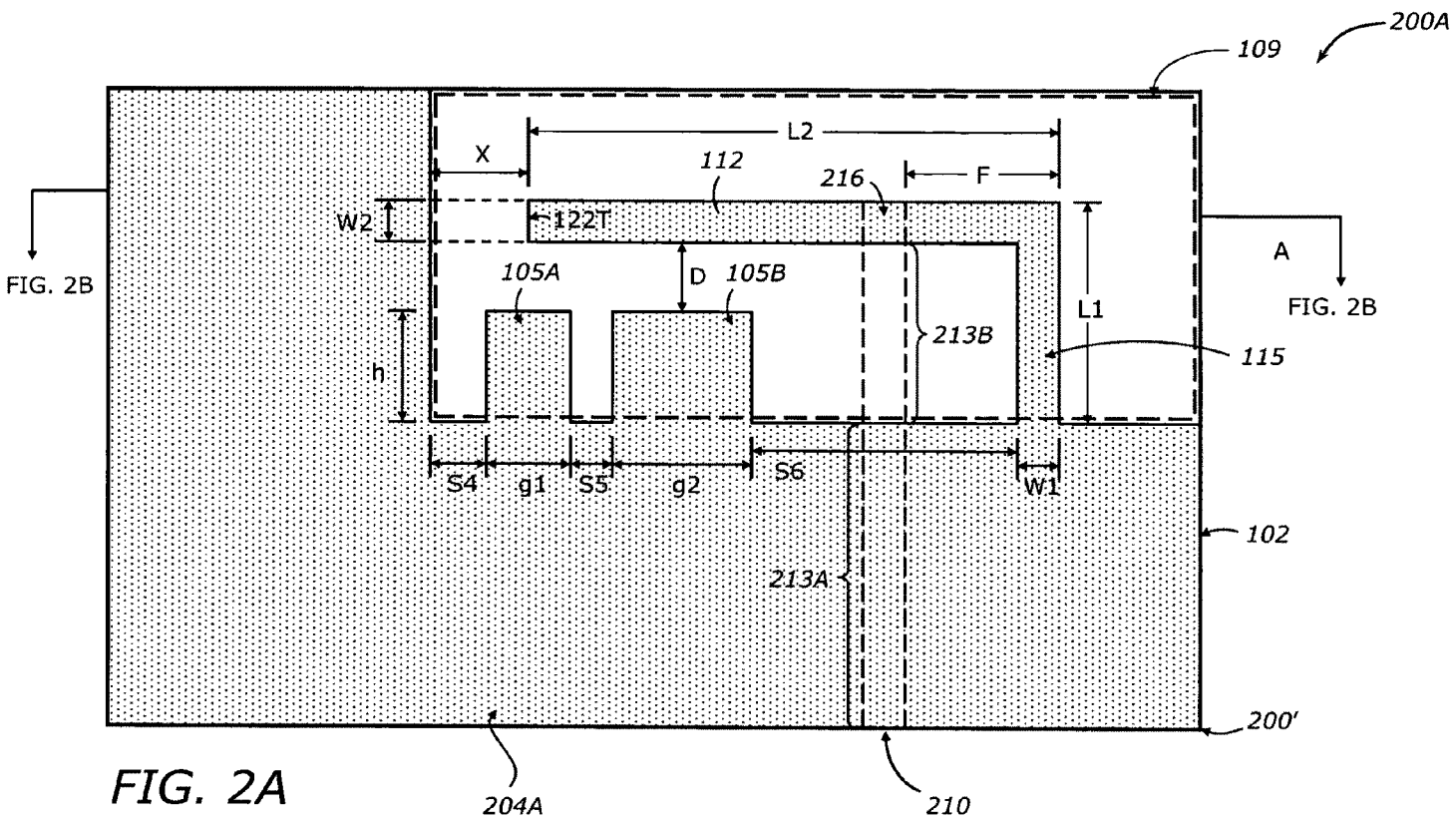
FIG. 2A is a top view of a third embodiment of a modified inverted-F antenna at a corner of a printed circuit board.
Figure 2B:
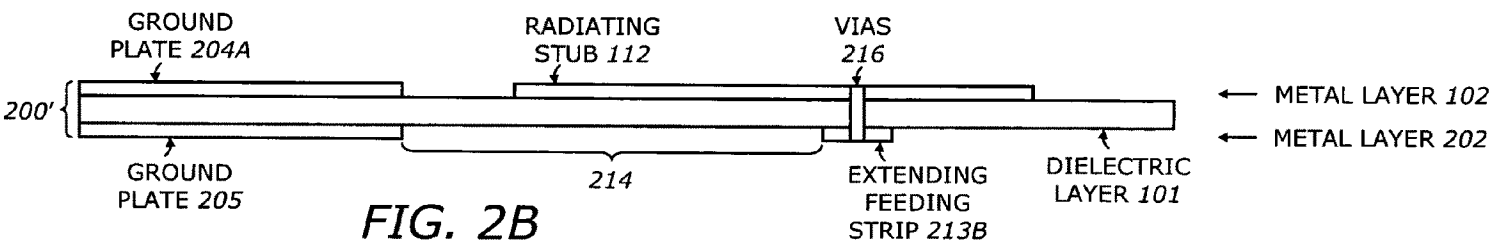
FIG. 2B is a cross-sectional view of the third embodiment of the modified inverted-F antenna along the radiating stub.

Referring now to FIGS. 2A-2B, a top and a cross-sectional view of a third embodiment of a modified inverted-F antenna 200A is illustrated. The cross-section of the PCB illustrated in FIG. 2B is along the radiating stub 112. In this third embodiment of a modified inverted-F antenna 200A, the feeding line is on a different layer of a printed circuit board 200' from that of the antenna. That is, the feeding line is on the opposite outer layer of a multilayer PCB from that of the antenna. In this case, the antenna may be considered as being formed on a multilayer substrate.

As illustrated in FIG. 2B, the radiating stub 112 of the modified inverted-F antenna 200A is formed in the first metal layer 102 formed on a first outer surface of the substrate dielectric layer 101. A feeding line 213A and an extended feeding strip 213B are formed in the second metal layer 202 on a second outer surface of the substrate 101, opposite the first outer surface.

With the feeding line 213A and the extended feeding strip 213B formed on one layer and the radiating stub 112 formed on a different layer, the feeding line 213A and extended feeding strip 213B may couple to the radiating stub 112 by way of a via-hole (VIA) 217 of the printed circuit board 200'. The VIA contact 216 is a metallized hole in the substrate and is coupled between the extended feeding strip 213B and the radiating stub 112 as is illustrated in FIG. 2B.

With the feeding line 213A and the extended feeding strip 213B formed on one layer and the radiating stub 112 formed on a different layer, a single ground plate 204 may be provided by the metal layer 102 around the antenna as is illustrated in FIG. 2A. In this case, the feeding line 213A under the ground plate 204 separated by the dielectric layer 101 effectively forms a micro-strip line 210 along the length of the feeding line 213A.

So that the modified inverted-F antenna 200A can effectively radiate, there are no metal strips or metal plates on any other layer in the area of the radiating stub 112 and the shortening leg 115 forming a portion of the modified inverted-F antenna, but for the extended feeding strip 213B which is coupled to the radiating stub 112 and forms a portion of the antenna. In FIG. 2B, the second ground plate 205 in metal layer 202 is substantially spaced apart from the extended feeding strip 213B by a spacing 214. The second ground plate 205 may overlap with portions of the first ground plate 204. Metal can be formed in the metal layer 202 almost anywhere but not under the antenna or in the aperture of the antenna dielectric window formed by the absence of metal in the metal layer 102, unless additional tuning is to be provided. Additional tuning of the antenna may be provided by the second external ground plate 205 including one or more grounded capacitive stubs formed in the metal layer 202 under and in parallel with the one or more grounded capacitive stubs 105,105A-105B.

Other elements of the modified inverted-F antenna 200A are similar to the modified inverted-F antenna 100A and have the same reference numbers and nomenclature. Accordingly, the description of these elements of the modified inverted-F antenna 200A is not repeated for reasons of brevity, it being understood that the description of the elements of antenna 100A is equally applicable to these elements of antenna 200A.

Figure 2C:
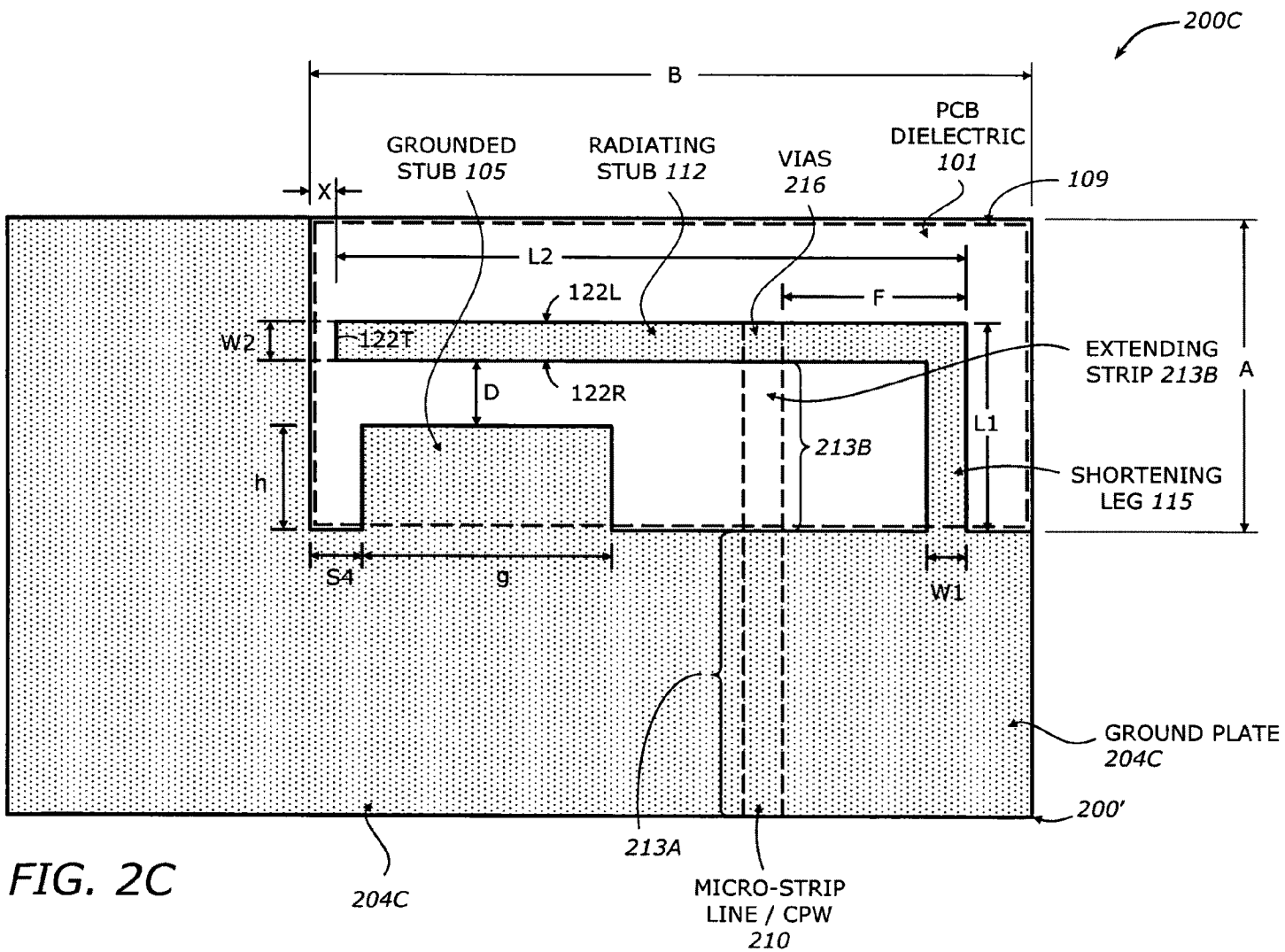
FIG. 2C is a top view of a fourth embodiment of a modified inverted-F antenna at a corner of a printed circuit board.
Figure 2D:
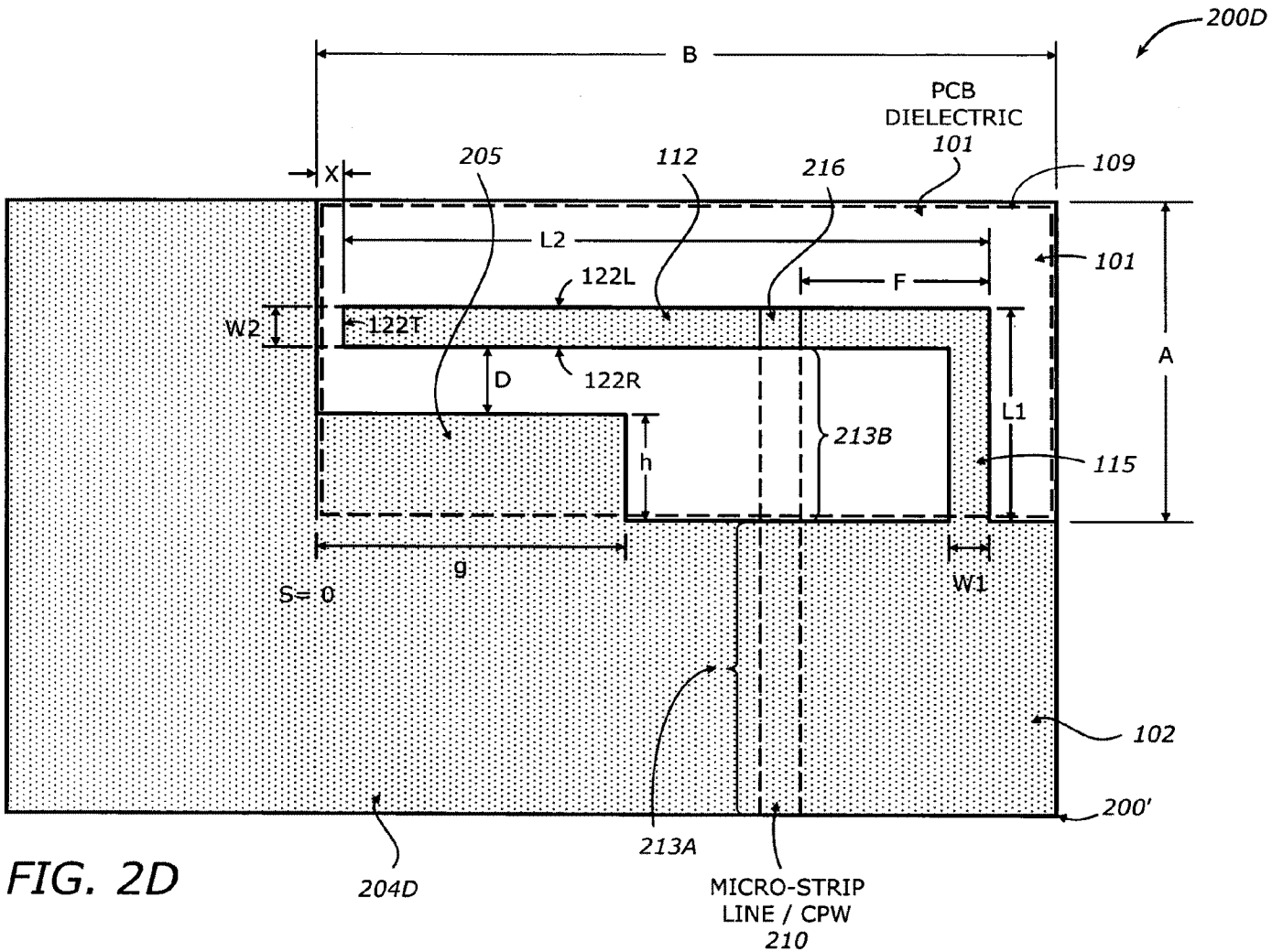
FIG. 2D is a top view of a fifth embodiment of a modified inverted-F antenna at a corner of a printed circuit board.

Referring now to FIGS. 2C-2D, a top view of fourth and fifth embodiments of a modified Inverted-F Antenna 200C-200D are illustrated. In each of the modified inverted-F antenna 200C-200D, the feeding line 213A is similar to that of the modified inverted-F antenna 200A effectively forming a micro-strip line 210 along the length of the feeding line 213A due to the ground plates 204C-204D and the dielectric substrate layer 101.

The modified inverted-F antennas 200C-200D are similar to the modified inverted-F antenna 200A but have only one grounded capacitive stub 105, 205. The grounded capacitive stub 105 of FIG. 2C has a width g and a space or gap S to the large surface area of the ground plate 204C. The grounded capacitive stub 205 of FIG. 2C has a width g with no space or gap S (i.e., S=0) to the large surface area of the ground plate 204D. In the exemplary embodiment shown in FIG. 2D, while spaced apart by D the top edge 122T of the radiating stub substantially extends into the width g of the grounded capacitive stub 205 with only a space X between the top edge 122T and the ground plate 204D being non-overlapping. That is, the first edge 122R of the radiating stub 112 is parallel with a top edge of the grounded capacitive stub 205 over a substantial part of its width g but for the space X.

Otherwise, the modified inverted-F antennas 200C-200D have similar elements to the modified inverted-F antenna 200A and use similar reference numbers and nomenclature. Accordingly, the description of the elements of the modified inverted-F antennas 200C-200D is not repeated for reasons of brevity, it being understood that the description of the elements of antennas 200A is equally applicable to the elements of antennas 200B-200D.

Previously, the embodiments of the modified inverted-F antennas were formed in a corner of the printed circuit board. However, the modified inverted-F antennas could also be formed along an edge of the printed circuit board.

Figure 3A:
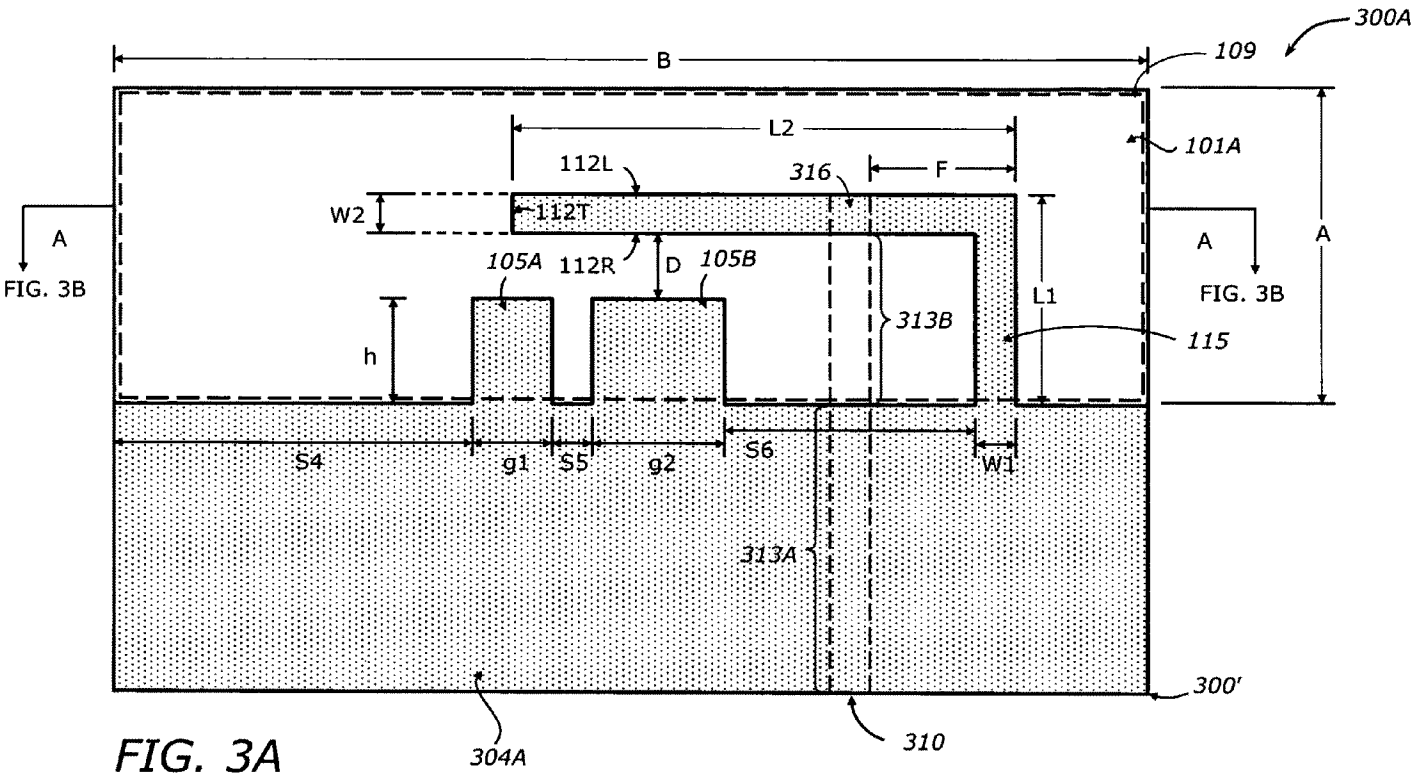
FIG. 3A is a top view of a sixth embodiment of a modified inverted-F antenna along an edge of a printed circuit board.
Figure 3B:
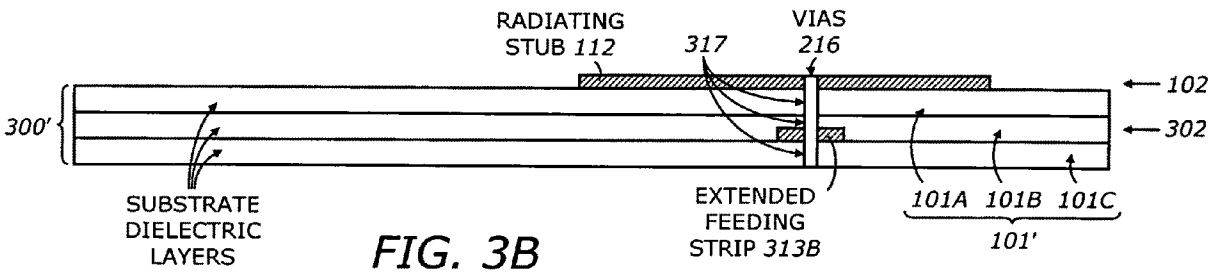
FIG. 3B is a cross-sectional view of the sixth embodiment of the modified inverted-F antenna along the radiating stub.

Referring now to FIGS. 3A-3B, a top and a cross-sectional view of a sixth embodiment of a modified inverted-F antenna 300A are illustrated. The cross-section of the PCB illustrated in FIG. 3B is along the radiating stub 112.

In this embodiment of a modified inverted-F antenna 300A, the feeding line is on a different layer of a printed circuit board 300' from that of the antenna. That is, the feeding line is on an interior layer of the substrate of a multilayer PCB while the antenna is formed on an outer surface of the substrate. In this case, the antenna may be considered as being formed on a multilayer substrate.

As illustrated in FIG. 3B, the radiating stub 112 of the modified inverted-F antenna 300A is formed in the first metal layer 102 on a first outer surface of the substrate layer 101A. A feeding line 313A and an extended feeding strip 313B may be formed in another metal layer 302 between substrate dielectric layers 101B and 101C and connected to radiating stub by a VIA as shown.

FIG. 3B illustrates a cross-section of the PCB 300' along the radiating stub 112. But for feeding line, the extended feeding strip, and top layer forming the antenna, metal plates on other layers are to be avoided under the radiating stub 112. That is, unnecessary metal is to be avoided in the dielectric window. However, in the area outside of the dielectric window under the grounded plate 304A, other metal plates can be formed between dielectric layers or in the second outer metal layer in order to complete the design of the PCB 300' for a wireless device.

As illustrated in FIG. 3A, the antenna is formed along an edge of the printed circuit board 300'. Grounded capacitive stubs 105A-105B coupled to the ground plate 304A are provided to tune the modified inverted-F antenna. However, as the antenna is formed along an edge, the space S4 is substantially large, even extending beyond the PCB 300'. As the space S4 provides no positional information for the grounded capacitive stubs in this design, the space S6 between the grounded capacitive stub 105B and the shortening leg 1135 is used.

The elements of the modified inverted-F antenna 300A, 300C including the shortening leg 115, the radiating stub 112, and the one or more grounded capacitive stubs 105A-105B appear to be extruded from the ground plate 304A. The radiating stub 112 has a first side edge 122R, a second side edge 122L, and a top edge 122T. In this case, the ground plate 304A is formed spaced apart along the first side edge 122R but not the top edge 122T of the radiating stub 112.

With the feeding line 313A and the extended feeding strip 313B formed on an interior layer and the radiating stub 112 formed on an outer layer of the substrate 101', the feeding line 313A and extended feeding strip 313B may couple to the radiating stub 112 by way of a VIA which is a metallized hole in the substrate 101' coupled between the extended feeding strip 313B and the radiating stub 112 as is illustrated in FIG. 3B.

With the feeding line 313A and the extended feeding strip 313B formed on one layer and the radiating stub 112 formed on a different layer, one or more ground plates 304A, 304B may be provided by the metal layer 102 around the antenna. Additionally, other additional internal layers of PCB structure as well as an outer layer may be formed on substrate 101 that are not illustrated in FIGS. 3A and 3C. In this case, the feeding line 313A between the ground plates of 304A and 304B and other outer layer and separated by the dielectric layers 101A-101C effectively forms a strip line 310 along the length of the feeding line 313A.

So that the modified inverted-F antenna 300A-300C can effectively radiate, there are no metal strips or metal plates on any other layer in the area of the radiating stub 112 and the shortening leg 115 forming a portion of the modified inverted-F antenna, but for the extended feeding strip 313B which is coupled to the radiating stub 112 and forms a portion of the antenna. However, a second ground plate (not shown) could be provided in opposite exterior surface and may overlap with portions of the first ground plate 304A, 304B. The second ground plate 205 may further include one or more grounded capacitive stubs in a metal layer to further tune the antenna.

Figure 3C:
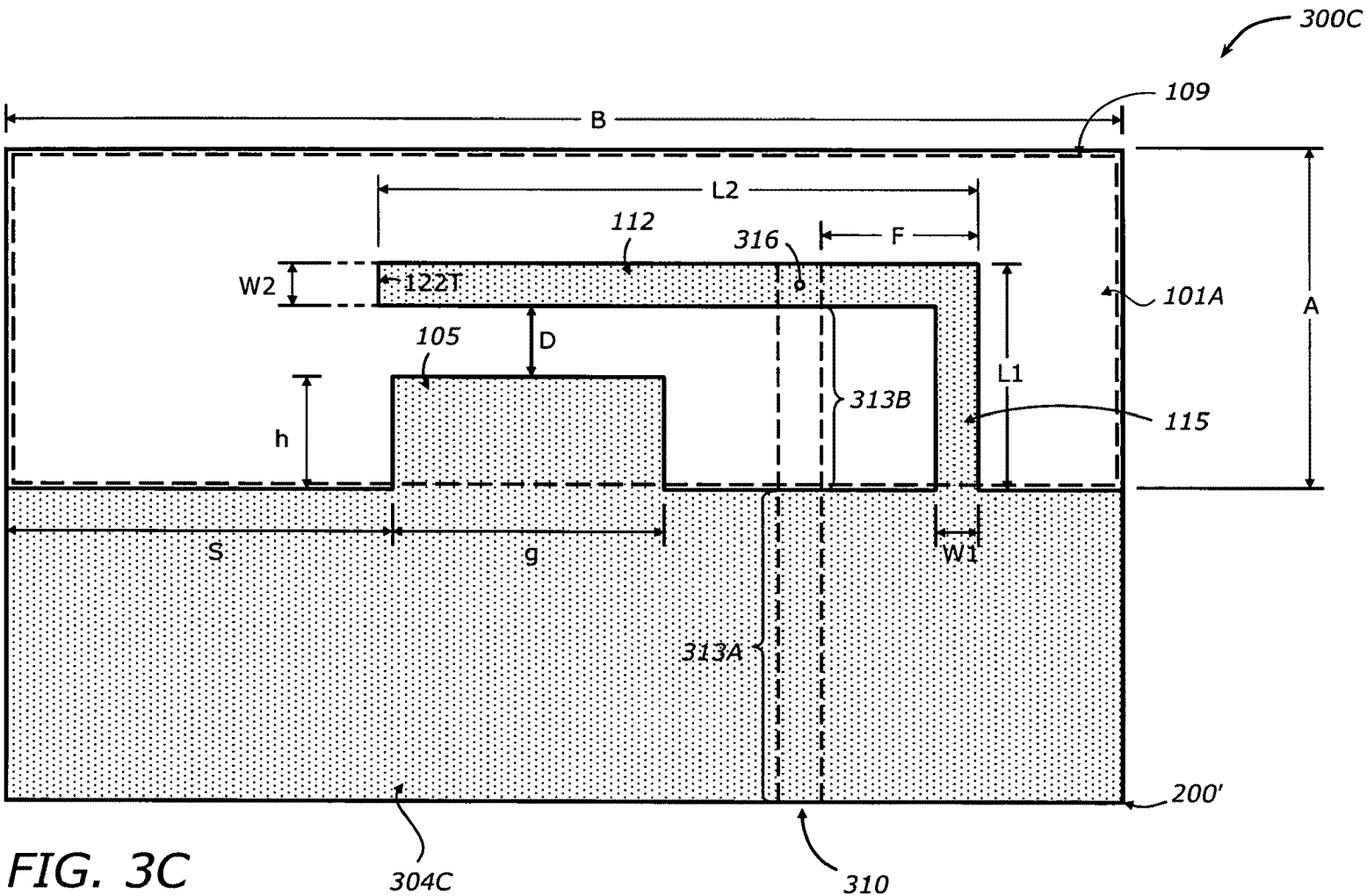
FIG. 3C is a top view of a seventh embodiment of a modified inverted-F antenna along an edge of a printed circuit board.

Referring now to FIG. 3C, a top view of seventh embodiment of a modified inverted-F antenna 300C is illustrated. In the modified inverted-F antenna 300C, the feeding line 313A is similar to that of the modified inverted-F antenna 300A effectively forming a strip line 310 along the length of the feeding line 313A due to the ground plates 304C and the dielectric substrate layer 101'.

The modified inverted-F antenna 300C is similar to the modified inverted-F antenna 300A but has only one grounded capacitive stub 105. The grounded capacitive stub 105 of FIG. 2C has a width g and a space or gap S that is very larger, similar to that of S4 of antenna 300A.

Otherwise, the modified inverted-F antenna 300C has similar elements to the modified inverted-F antenna 300A and use similar reference numbers and nomenclature. Accordingly, the description of the elements of the modified inverted-F antennas 300C is not repeated for reasons of brevity, it being understood that the description of the elements of antenna 300A is equally applicable to the elements of antenna 300C.

Figure 4:
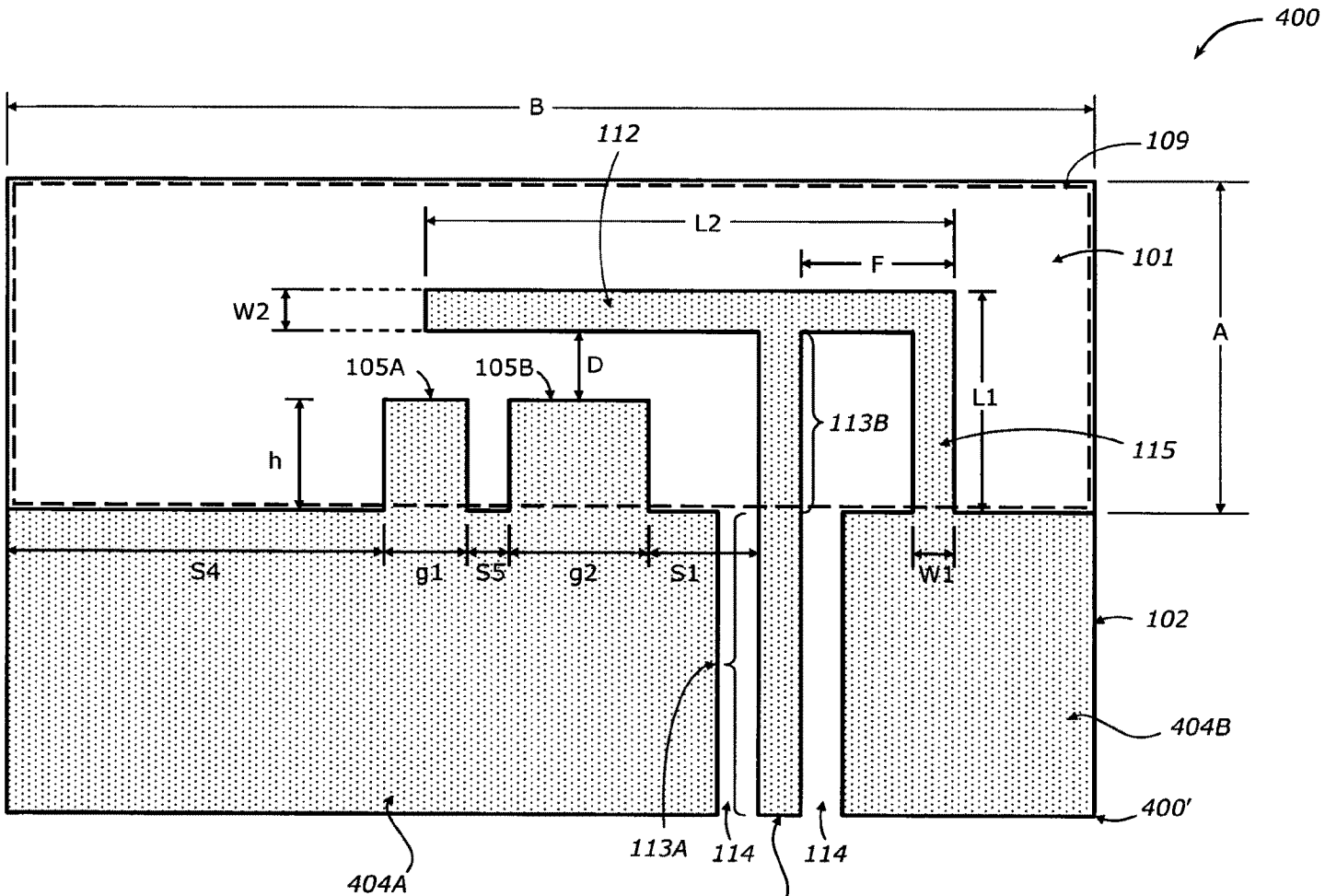
FIG. 4 is a top view of an eighth embodiment of a modified inverted-F antenna along an edge of a printed circuit board.

Referring now to FIG. 4, a top view of an eighth embodiment of a modified inverted-F antenna 400 is illustrated. In the modified inverted-F antenna 400, a grounded coplanar waveguide 110 is used as the feeding line to the radiating stub 112. The elements of the antenna 400 are formed in the same metal layer 102 on the same outer surface of the substrate layer 101. The large area metal plates 404A, 404B are grounded and at least there is one metal plate on the internal or other outer layer of substrate to form the grounded coplanar waveguide.

The elements of the modified inverted-F antenna 400 appear to be extruded from the ground plates 404A-404B. The shortening leg 115 and the radiating stub 112 appear to be extruded from the ground plate 404B. The one or more grounded capacitive stubs 105A-105B appear to be extruded from the ground plate 404A.

As illustrated in FIG. 4, the antenna 400 is formed along an edge of the printed circuit board 400'. Grounded capacitive stubs 105A-105B coupled to the ground plate 404A are provided to tune the inverted-F antenna 400. However, as the antenna is formed along an edge, the space S4 is substantially large, even extending beyond the PCB 400'. That is, the ground plate 404A is along a side edge of the radiating stub 112 and not a top edge of the radiating stub 112. As the space S4 provides no positional information for the grounded capacitive stubs in this design, the space S1 between the grounded capacitive stub 105B and the center strip 113A is used.

Details of using the grounded coplanar waveguide 110 as the feeding transmission line were previously described with reference to FIGS. 1A-1B.

Moreover, other elements of the modified inverted-F antenna 400 are similar to the modified inverted-F antenna 100A and have the same reference numbers and nomenclature. Accordingly, the description of these elements of the modified inverted-F antenna 400 is not repeated for reasons of brevity, it being understood that the description of the elements of antenna 100A is equally applicable to these elements of antenna 400.

Additionally, while FIG. 4 illustrates a plurality of grounded capacitive stubs 105A-105B to tune the antenna 400 along the edge of the PCB 400', one grounded capacitive stub 105 may be used instead, such as is shown by FIG. 1B.

Figure 5:
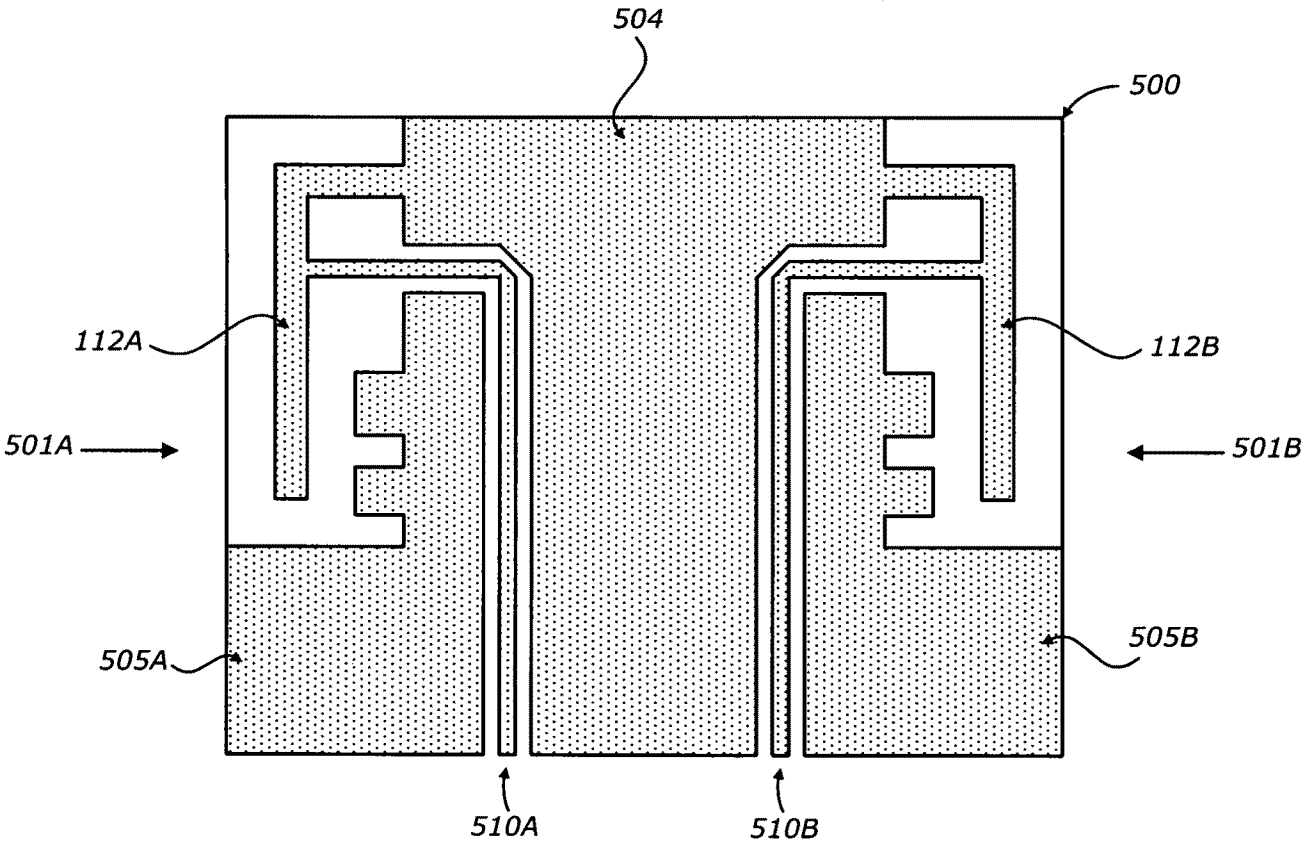
FIG. 5 is a top view of a pair of modified inverted-F antennas in the corners of the PCB with grounded coplanar waveguide feeding lines for use in a CardBus application.

Referring now to FIG. 5, an antenna circuit as a portion of a printed circuit board 500 for use in a Cardbus wireless adapter is illustrated. The PCB 500 includes a pair of modified inverted-F antennas 501A-501B in opposite corners of the PCB. The antennas 501A-501B are each an instance of the antenna 100A described previously with respect to FIG. 1A and include grounded coplanar waveguide feeding lines 510A-510B for each respective antenna. The grounded coplanar waveguide feeding lines 510A-510B are formed in the same metal layer and the same substrate surface as that of the modified the inverted-F antennas 501A-501B. Note that the modified inverted-F antennas 501A-501B share one ground plate 504 coupled to the radiating stubs 112A-112B to conserve space. The additional ground plates 505A-505B couple ground to the grounded capacitor stubs 105A-105B of each antenna.

Figure 6:
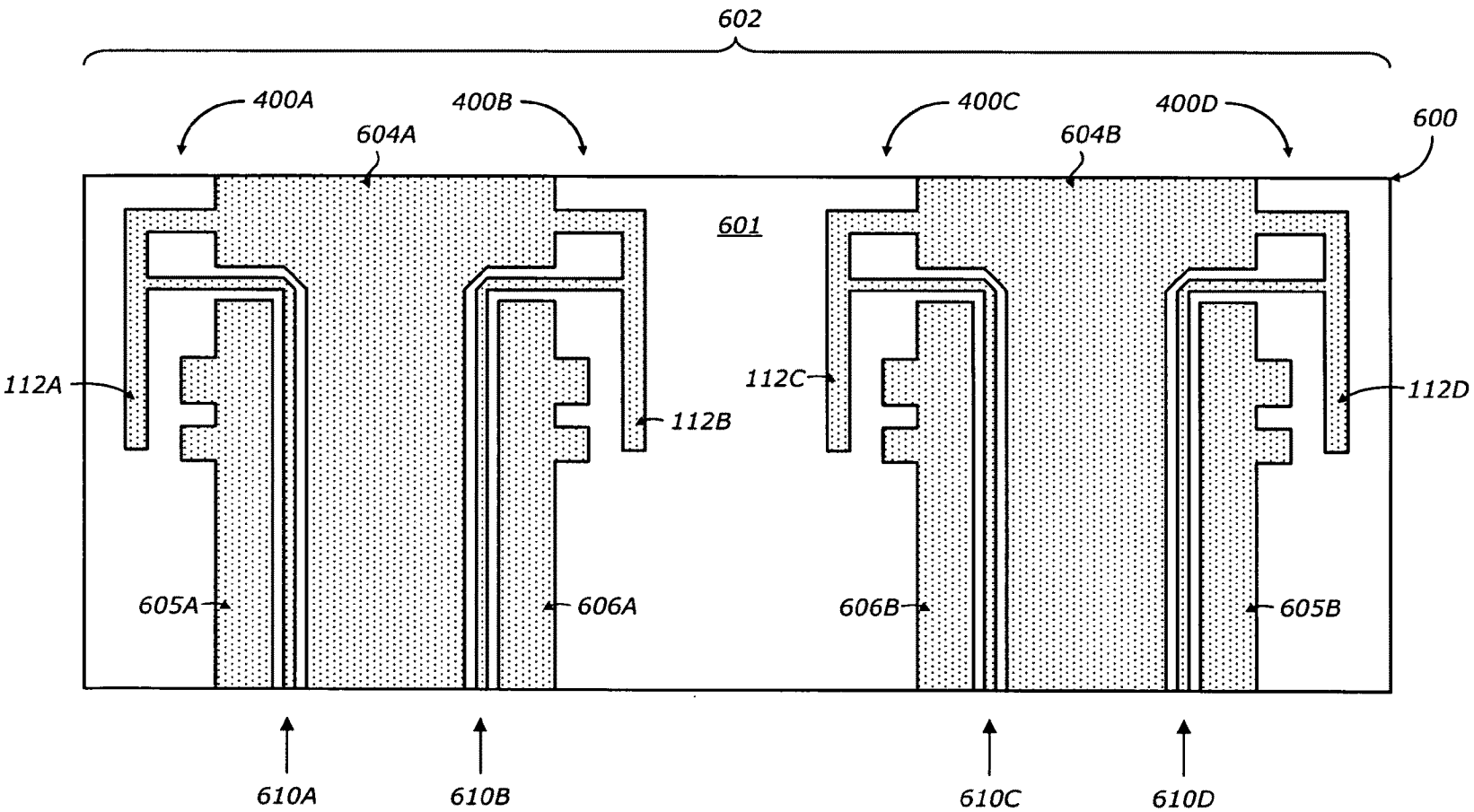
FIG. 6 is a linear antenna array of four modified inverted-F antennas extruded from the ground plates with grounded coplanar waveguide feeding lines.

Referring now to FIG. 6, an antenna circuit as a portion of a printed circuit board 600 is illustrated including a linear antenna array 602 of four modified inverted-F antennas 400A-400D on a substrate 601. The four modified inverted-F antennas 400A-400D are extruded from the ground plates 604A-604B, 605A-606B, 606A-606B and are each an instance of the antenna 400 described previously with respect to FIG. 4. Each antenna 400A-400D respectively includes grounded coplanar waveguide feeding lines 610A-610D. The linear antenna array is located at one end of the PCB 600 with antennas 400A and 400D along an edge thereof. In this case, the parameter S4 for each antenna is very large.

The grounded coplanar waveguide feeding lines 610A-610D are formed in the same metal layer and the same substrate surface as that of the modified the inverted-F antennas 400A-400D. Note that the modified the inverted-F antennas 400A-400B share the ground plate 604A coupled to the radiating stubs 112A-112B to conserve space. The modified the inverted-F antennas 400C-400D share the ground plate 604B coupled to the radiating stubs 112C-112D.

Figure 7:
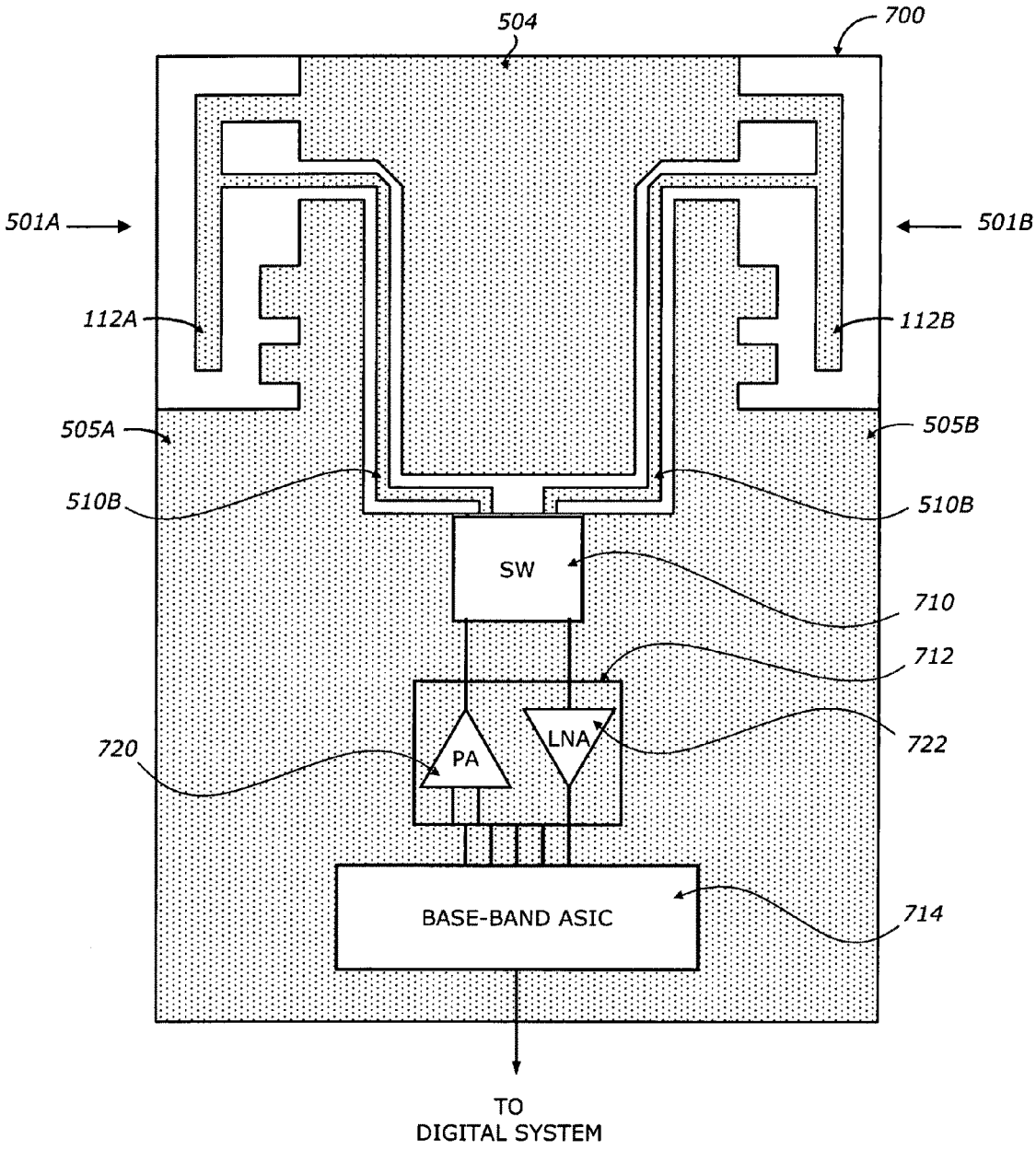
FIG. 7 is a high level block diagram including the antenna design of FIG. 5 and a system using switching diversity technology.
Figure 8:
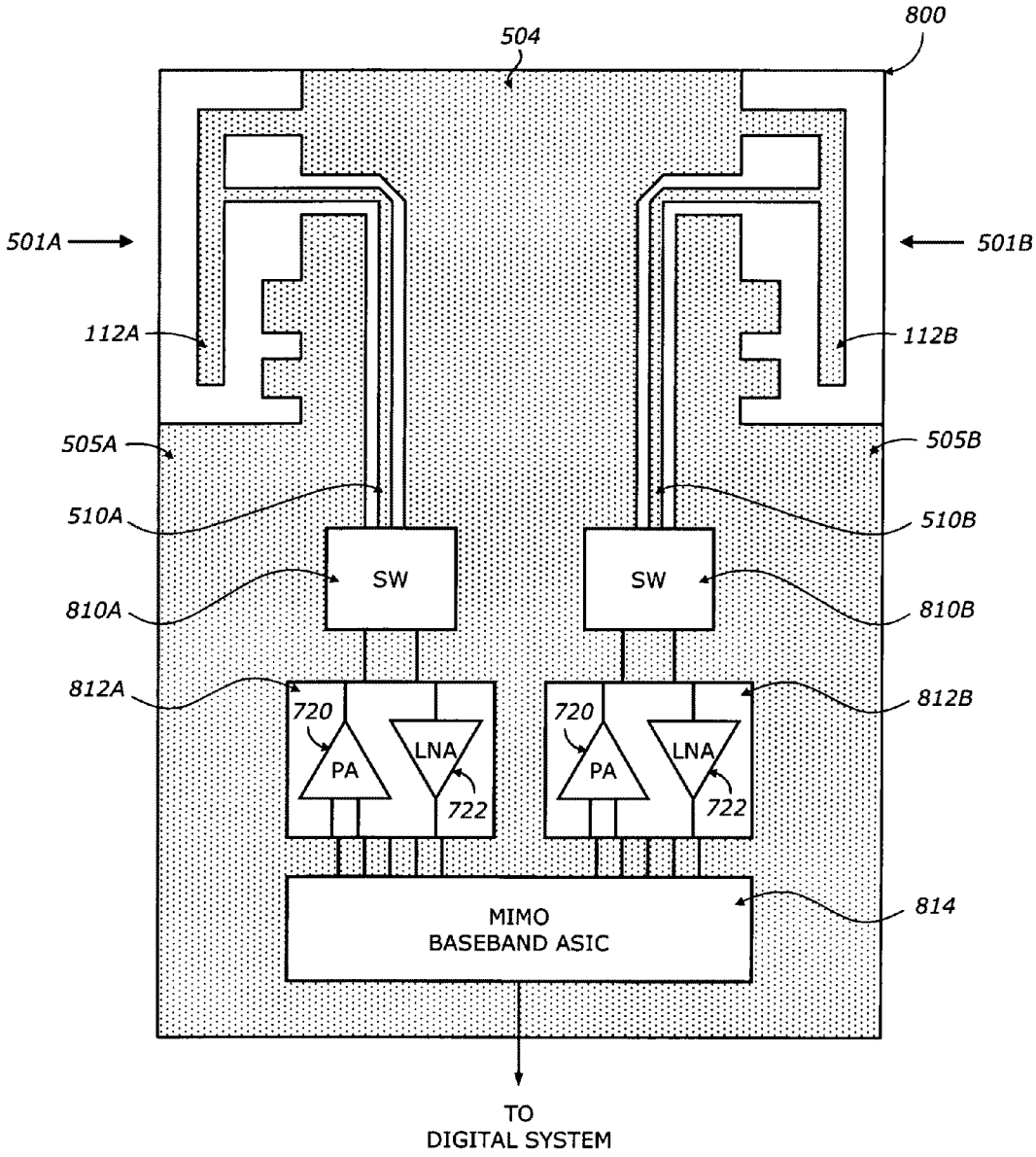
FIG. 8 is a high level block diagram including the antenna design of FIG. 5 and a system using 2×2 MIMO technology.

Referring now to FIGS. 7 and 8, high level block diagrams of systems including the antenna circuit of FIG. 5 are now described. The system illustrated in FIG. 7 uses switching diversity technology while the system illustrated in FIG. 8 employs 2×2 MIMO technology.

In FIG. 7, the modified inverted-F antennas 501A-501B are formed as part of the printed circuit board 700. A large ground plane 705 is coupled to the ground plates 505A-505B and the shared ground plate 504 without interrupting the grounded coplanar waveguide feeding lines 510A-510B.

The pluggable wireless subscriber system further includes an antenna switch (SW) 710, an RF transceiver (TRX) 712, and a base-band application specific integrated circuit (ASIC) or processor 714 coupled together as shown. The antenna switch 710 is a double-pole-double-throw RF switch. The antenna switch 710 switches between the transmitting signal and the receiving signal. The RF transceiver 712 includes in particular a power amplifier (PA) 720 to transmit signals and a low noise amplifier (LNA) 722 to receive signals. The base-band ASIC 714 is a mixed signal integrated circuit interfacing with the RF transceiver 720 by way of analog signals on the one hand and a digital system by way of digital signals on the other hand.

An additional RF band-pass filter or an RF low-pass filter may be coupled between the antenna and the transmitting power amplifier 720 and the receiving low noise amplifier 722.

As mentioned previously, the system of FIG. 7 uses switching diversity technology which is supported by the ASIC 714 and the antenna switch 710 which is controlled by the ASIC. As previously discussed, the RF transceiver 712 includes a power amplifier (PA) 720 to transmit signals and a low noise amplifier (LNA) 722 to receive signal. The switch 710 is used to select the antenna providing the best signal quality for both transmit signals and receive signals. The switch 710 is then used to toggle between coupling the PA 720 and the LNA 722 to the selected antenna in order to transmit and receive signals over the same antenna.

In FIG. 8, the modified inverted-F antennas 501A-501B are also formed as part of a printed circuit board 800. A large ground plane 805 is coupled to the ground plates 505A-505B and the shared ground plate 504 without interrupting the grounded coplanar waveguide feeding lines 510A-510B.

The pluggable wireless subscriber system further includes respective pairs of antenna switches (SW) 810A-810B and RF transceivers (TRX) 812A-812B along with a MIMO base-band application specific integrated circuit (ASIC) 814 coupled together as shown. The pair of antenna switches 810A-810B are single-pole-double-throw RF switches. Each of the RF transceivers 812A-812B includes in particular a PA 720 to transmit signals and an LNA 722 to receive signals. The MIMO base-band ASIC 814 is a mixed signal integrated circuit interfacing with the RF transceivers 820A-820B by way of analog signals on the one hand and a digital system by way of digital signals on the other hand.

As mentioned previously, the system of FIG. 8 uses using 2×2 MIMO technology which is supported by the ASIC 814 and the antenna switches 810A-810B which are controlled by the ASIC. In this case, both of the antennas 501A-501B are simultaneously used to transmit or receive signals. The MIMO base-band ASIC 814 coherently combines these signals to generate a better signal than either antenna could individually provide.

Antenna 501A is coupled to antenna switch 810A through the grounded coplanar waveguide 510A. Antenna 501B is coupled to antenna switch 810B through the grounded coplanar waveguide 510B. Transceiver 812A is coupled to antenna switch 810A. Transceiver 812B is coupled to antenna switch 810B. In this case, the antenna switches 810A-810B do not switch between antennas 501A-501B. Instead, the switches in this case switch only between transmit and receive in coupling either the power amplifier 720 or the low noise amplifier 722 to the antenna in order to transmit or receive signals. That is, the switches 810A-810B are used to toggle between coupling the PA 720 and the LNA 722 to the selected antenna in order to transmit and receive signals over the same antenna.

FIG. 9 illustrates a graph of the input return loss of a modified inverted-F antenna for a CardBus printed circuit board such as illustrated in FIG. 5. The modified inverted-F antennas 501A-5-1B of FIG. 5 are designed for a 3.5 GHz WiMAX frequency band on the form-factor of a CardBus pluggable card.

Curve 901 illustrates the input return loss of the antenna alone. Curve 902 illustrates the input return loss of the antenna with a radome assembled over it.

Figure 13A:
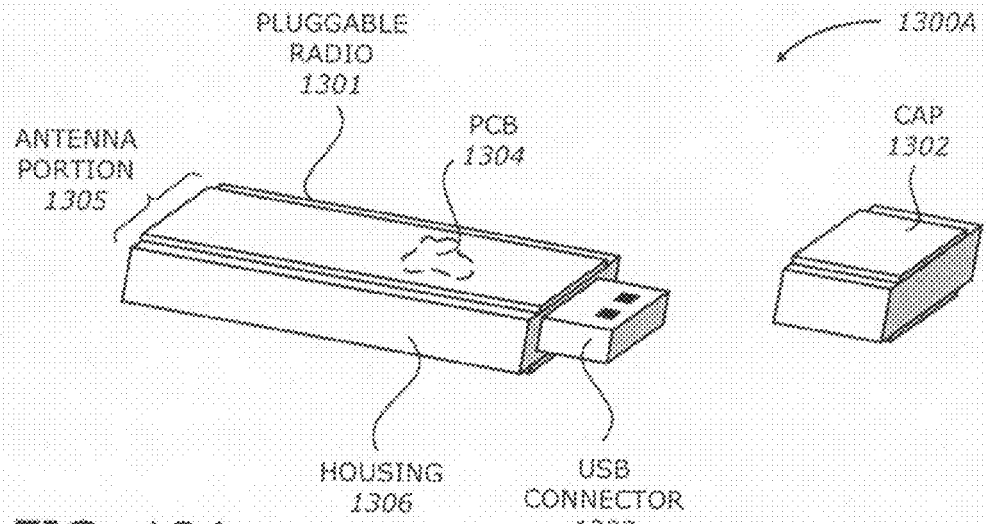
FIG. 13A illustrates a wireless universal serial bus (USB) adapter including a printed circuit board with embodiments of the modified inverted-F antenna for use by a subscriber unit.
Figure 13B:
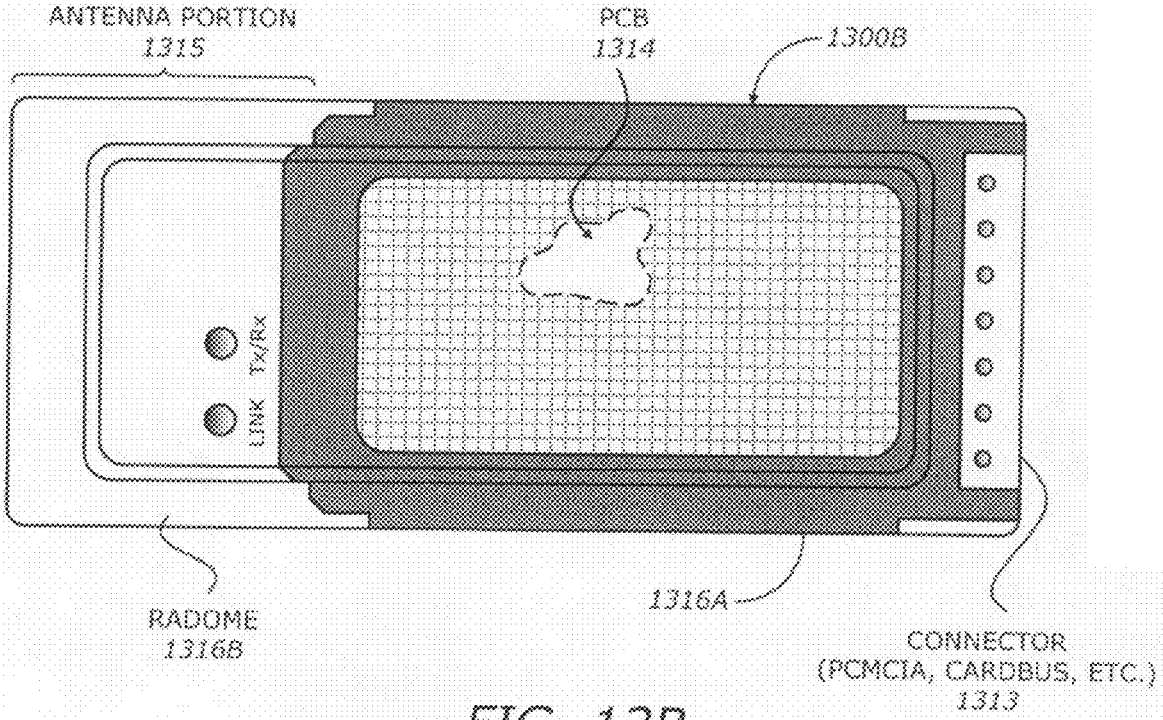
FIG. 13B illustrates another wireless card or adapter including a printed circuit board with embodiments of the modified inverted-F antenna.

A radome is a shell or housing that is transparent to radio-frequency radiation that is often used to cover and protect an antenna from environmental elements. FIG. 13B illustrates a radome 1316 over an antenna portion 1315 of a pluggable wireless adapter card 1300B. In FIG. 13A, the radome is a housing 1306 covering over the entire printed circuit board including the antenna portion 1305 of the pluggable USB adapter 1300A.

In comparing the input return loss curves 901 and 902 of FIG. 9, the presence of a radome over the modified inverted-F antenna does not degrade its matching performance. On the contrary, the presence of a radome over the modified inverted-F antenna improves the matching performance of the antenna.

Referring now to FIGS. 10 and 11, charts of far field radiation patterns for a Cardbus antenna design are illustrated. FIG. 10 illustrates a chart of the far field radiation pattern in a horizontal plane for the CardBus design including the modified inverted-F Antennas as shown in FIG. 5. FIG. 11 illustrates a chart of the far field radiation pattern in a vertical plane for the CardBus design including modified inverted-F antennas shown in FIG. 5.

The CardBus antenna design of FIG. 5 was used to take these measurements. Each antenna was measured using a grounded coplanar waveguide feeding line formed on the same outer layer as the radiating stubs. It was determined that the measured and calculated gain of the Cardbus Antenna design of FIG. 5, including the modified inverted-F antennas, was substantially 3.1 decibels (dBi).

Figure 12:
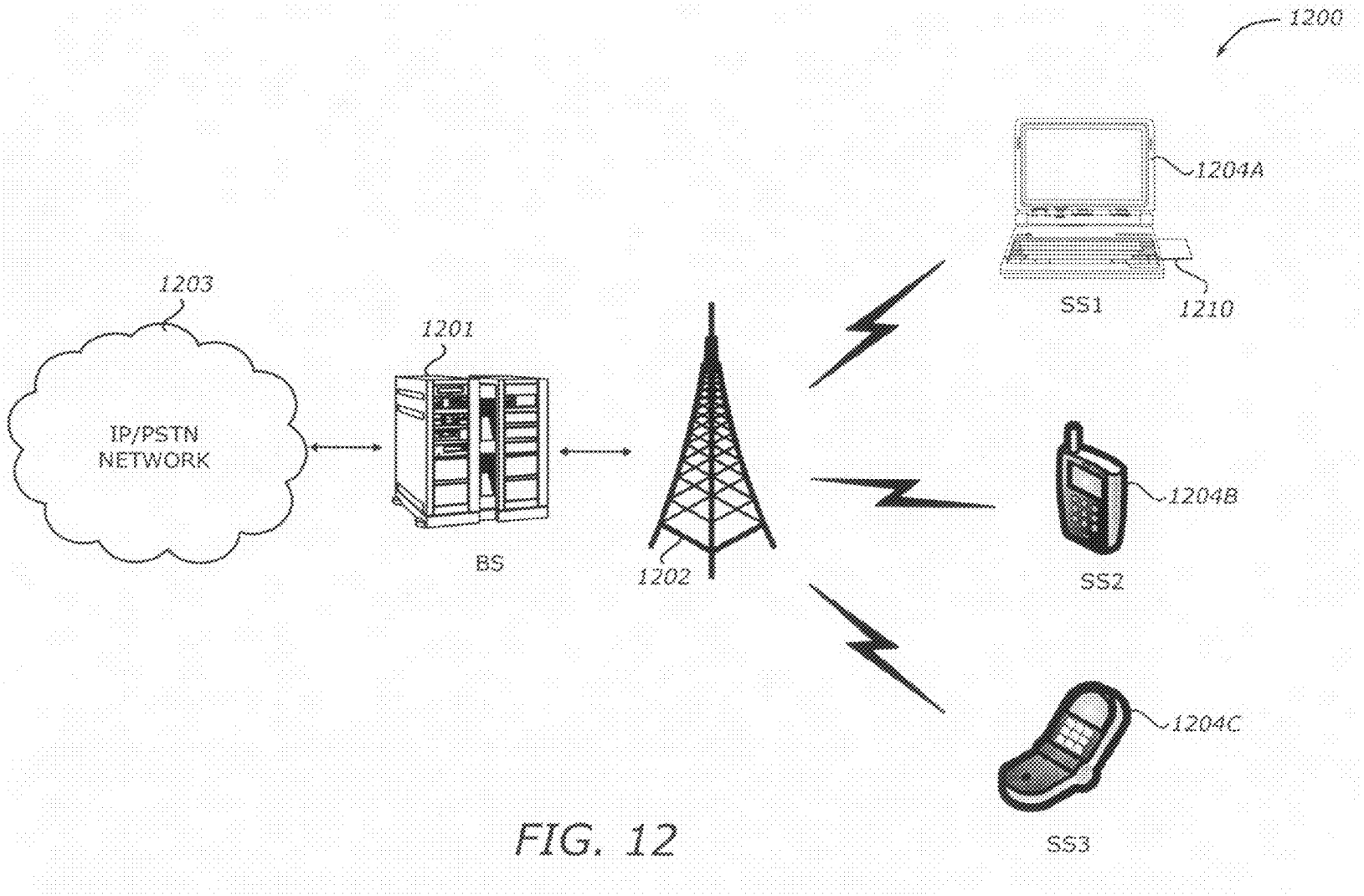
FIG. 12 illustrates a wireless communication network with subscriber units employing embodiments of the invention.

Referring now to FIG. 12, a wireless communication network 1200, such as that based on an Institute of Electronics and Electrical Engineers (IEEE) 802.16 standard, with subscriber units employing embodiments of the invention is illustrated. The wireless communication network 1200 includes one or more base stations (BS) 1201 and one or more mobile or fixed subscriber stations (SS) 1204A-1204C to communicate both and voice and data signals there-between and over the Internet Protocol/Public Switched Telephone Network (IP/PSTN) network. Once a SS 1204A-1204C is registered to the BS 1201, it can connect to the Internet through the BS that is connected to the network cloud 1203.

The antennas described herein are designed to be used with wireless communication systems operating with frequency bands in accordance with IEEE 802.11, IEEE 802.15, IEEE 802.16-2004, IEEE 802.16e, and cellular communication standards. IEEE 802.16-2004 and 802.16e standards describe air interfaces for fixed and mobile broadband wireless access systems respectively and these are for MAN (Metropolitan Area Network) or WAN (Wide Area Network) while there are different standards for wireless PAN (Personal Area Network) and wireless LAN (Local Area Network) such as IEEE 802.15 which is known as Bluetooth and IEEE 802.11 which is known as Wi-Fi to the public.

The printed circuit boards with the antennas described herein may be fixed and designed into a subscriber unit. Alternatively, the printed circuit boards with the antennas described herein may be plugged into the subscriber unit to become a part thereof as well as being unplugged and used with a different subscriber unit. That is, the radio device with the printed circuit boards having the antennas described herein may be pluggable. In the wireless communication system 1200 illustrated by FIG. 12, the subscriber station 1204A includes a pluggable wireless adapter 1210.

Referring now to FIGS. 13A-13B, pluggable radio devices are illustrated that include printed circuit boards having the modified inverted-F antennas described herein. These pluggable radio devices and their antennas are particularly useful to operate subscriber stations according to the IEEE 802.16 standards that include WiMAX, Mobile WiMAX and Wireless Broadband (WiBro) specifications.

FIG. 13A illustrates a wireless universal serial bus (USB) adapter 1300A including a printed circuit board 1304 with embodiments of the modified inverted-F antenna for use as part of a subscriber unit. The adapter 1300A includes a pluggable radio portion 1301 and a cap portion 1302. The pluggable radio 1301 includes the printed circuit board 1304 that has an antenna portion 1305 at one end and a USB connector 1303 at an opposite end. The radio 1301 further has a housing 1306 that covers over the internal printed circuit board 1304 that includes the modified inverted-F antenna. The housing 1306 is transparent to radio signals and acts as a radome to protect the antenna on the PCB 1304.

FIG. 13B illustrates another wireless card or adapter 1300B including a printed circuit board 1314 with embodiments of the modified inverted-F antenna. The card 1300B includes the printed circuit board 1314 with an antenna portion 1315 at one end and a connector 1313 at an opposite end. A metallic housing 1316A encloses a portion of the PCB while a radome housing 1316B covers over the modified inverted-F antennas. Depending upon the type of adapter or card, the connector 1313 may be of various types such as PCMCIA connector, CardBus connector, etc.

Each of the adapters 1300A-1300B is very limited in the size or form factor of the radio device so that they are very portable. The modified inverted-F antenna that is formed as part of the printed circuit board as described previously (sometimes referred to as being "printed", on the PCB as a "printed antenna") is well suited to these small form factor applications.

Figure 14:
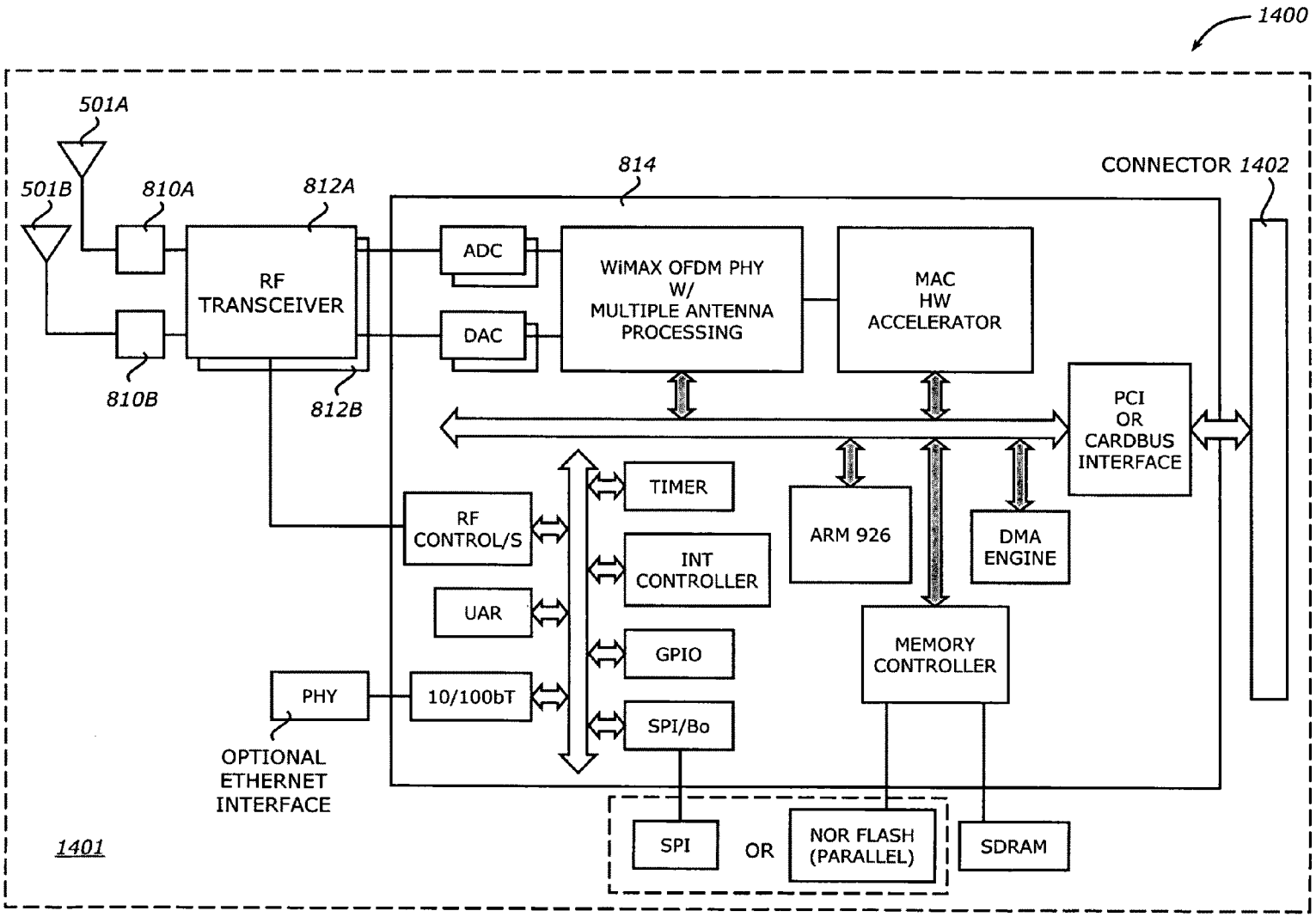
FIG. 14 illustrates a functional block diagram of a wireless card including a printed circuit board with embodiments of the modified inverted-F antenna.

Referring now to FIG. 14, a functional block diagram of a wireless card 1400 including a printed circuit board 1401 with modified inverted-F antennas 501A-501B is illustrated. The functional block diagram of the wireless card 1400 includes a functional block diagram of the MIMO base-band ASIC 814 previously described with reference to FIG. 8. The MIMO base-band ASIC 814 has an interface to couple to a connector 1402 of the card 1400. The connector 1400 is pluggable into a wide variety of digital devices to provide wireless communication.

Figure 15:
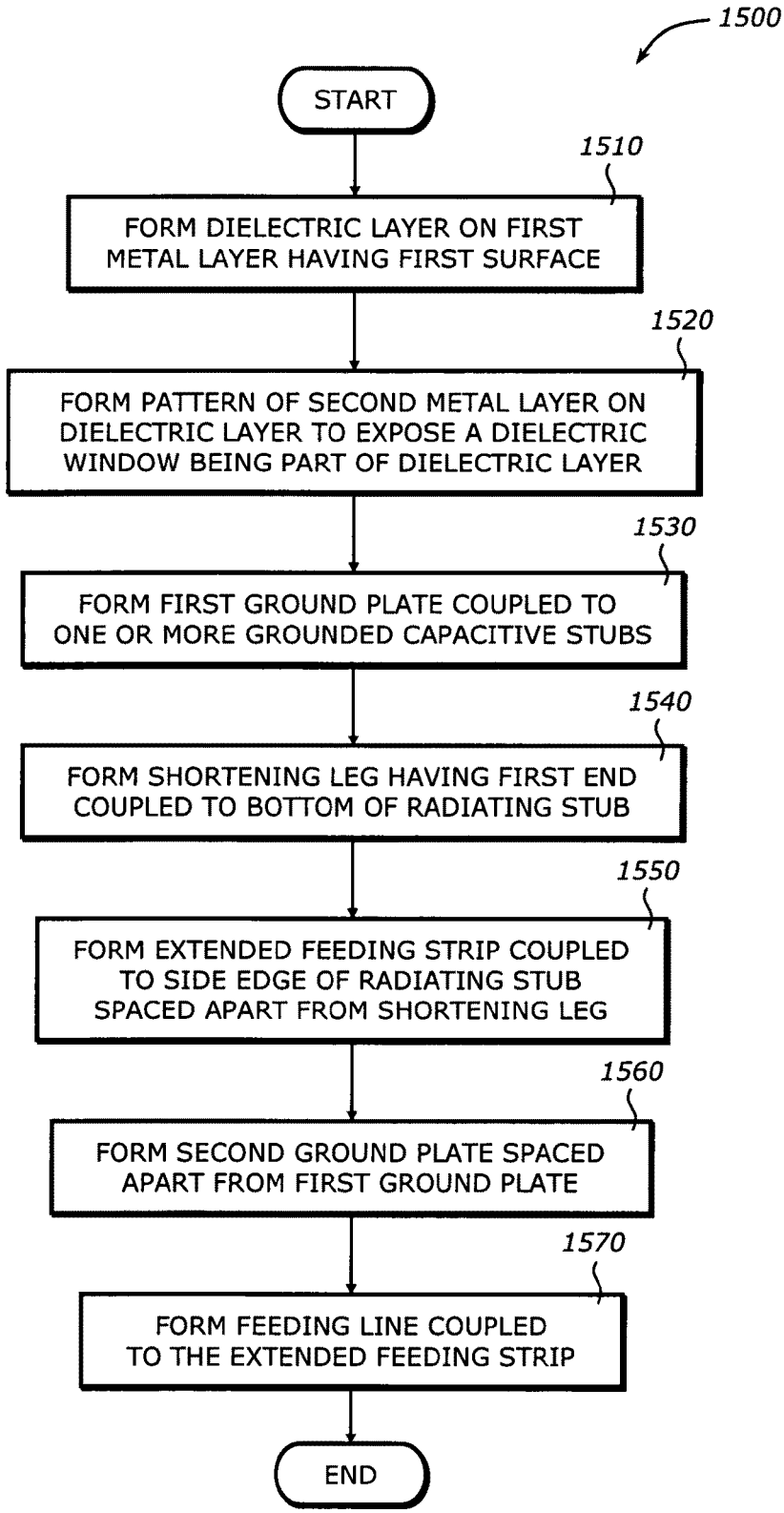
FIG. 15 is a flowchart illustrating a process to form a modified inverted-F antenna according to one embodiment of the invention.

FIG. 15 is a flowchart illustrating a process 1500 to form a modified inverted-F antenna according to one embodiment of the invention.

Upon START, the process 1500 forms a dielectric layer on a first metal layer having a first surface (Block 1510). Next, the process 1500 forms a pattern of a second metal layer on the dielectric layer to expose a dielectric window being part of the dielectric layer (Block 1520). The pattern has a radiating stub and one or more grounded capacitive stubs spaced apart from the radiating stub. The one or more grounded capacitive stubs extend from a first edge of the first ground plate parallel with a side edge of the radiating stub Then, the process 1500 forms a first ground plate coupled to the one or more grounded capacitive stubs (Block 1530). The first ground plate is part of the second metal layer and coupled to ground. Next, the process 1500 forms a shortening leg having a first end coupled to a bottom of the radiating stub (Block 1540). The shortening leg has a second end opposite the first end is coupled to the first ground plate Then, the process 1500 forms an extended feeding strip coupled to the side edge of the radiating stub spaced apart from the shortening leg (Block 1550). The radiating stub, the shortening leg, and the extended feeding strip are coupled together to form an F shape.

Next, the process 1500 forms a second ground plate spaced apart from the first ground plate (Block 1560). The second ground plate is coupled to ground and a second end of the shortening leg opposite the first end. Then, the process 1500 forms a feeding line coupled to the extended feeding strip (Block 1570). The feeding line is a grounded coplanar waveguide having a central strip spaced apart from the first ground plate and the second ground plate forming a pair of gaps. The process 1500 is then terminated.

The process 1500 is a representative process to form the modified inverted-F antenna circuit. Additional processes may be used to form the various embodiments of the modified inverted-F antenna circuit as described above.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting.

What is claimed is:

1. An apparatus comprising:

a dielectric substrate having a first surface;

a radiating stub on the first surface of the dielectric substrate; and a first ground plate on the first surface of the dielectric substrate to couple to ground, the first ground plate including one or more grounded capacitive stubs spaced apart from the radiating stub, the one or more grounded capacitive stubs to tune performance parameters.

2. The apparatus of claim 1 wherein the one or more grounded capacitive stubs extend from a first edge of the first ground plate parallel with a side edge of the radiating stub.

3. The apparatus of claim 1 further comprising:

a shortening leg having a first end coupled to a bottom of the radiating stub; and an extended feeding strip coupled to the side edge of the radiating stub spaced apart from the shortening leg; wherein the radiating stub, the shortening leg, and the extended feeding strip are coupled together to form an F shape.

4. The apparatus of claim 3 wherein the shortening leg has a second end opposite the first end is coupled to the first ground plate.

5. The apparatus of claim 1 further comprising:

a second ground plate spaced apart from the first ground plate, the second ground plate to couple to ground, and wherein the shortening leg has a second end opposite the first end is coupled to the second ground plate.

6. The apparatus of claim 3 further comprising:

a feeding line coupled to the extended feeding strip.

7. The apparatus of claim 6 wherein the feeding line is a grounded coplanar waveguide having a central strip spaced apart from the first ground plate and the second ground plate forming a pair of gaps.

8. The apparatus of claim 7 further comprising:

a third ground plate on a second surface of the dielectric substrate opposite the first surface, the third ground plate to couple to ground, the third ground plate under the central strip and the pair of gaps.

9. The apparatus of claim 8 wherein the extended feeding strip is formed in a second metal layer on the second surface of the dielectric substrate opposite the first surface, and the feeding line is a micro-strip line coupled to the extended feeding strip and formed in the second metal layer on the second surface of the dielectric substrate.

10. The apparatus of claim 9 further comprising:

a metal conductor within a via hole of the dielectric substrate coupled between the extended feeding strip and the radiating stub.

11. The apparatus of claim 1 wherein the first ground plate has a second edge perpendicular to the first edge of the first ground plate spaced apart from and parallel with a top edge of the radiating stub.

12. The apparatus of claim 1 wherein the one or more grounded capacitive stubs is a single grounded capacitive stub extending from the first edge of the first ground plate pointing towards the radiating stub, and the radiating stub is parallel with the single grounded capacitive stub such that a top edge of the radiating stub extends beyond the width of the single grounded stub into a space with the first ground plate.

13. The apparatus of claim 1 wherein the one or more grounded capacitive stubs is a first grounded capacitive stub and a second grounded capacitive stub in parallel, spaced apart, and extending from the first edge of the first ground plate pointing towards the radiating stub, and the radiating stub is parallel with the first and second grounded capacitive stubs such that a top edge of the radiating stub extends beyond the width of the first grounded capacitive stub and a space between the first and second grounded capacitive stubs, up to a midpoint in the width of the second grounded capacitive stub.

14. The apparatus of claim 1 wherein the first ground plate forms a dielectric window in the surface of the dielectric substrate that is encroached by the radiating stub and the one or more grounded capacitive stubs.

15. The apparatus of claim 5 wherein the first ground plate and the second ground plate form a dielectric window in the surface of the dielectric substrate that is encroached by the radiating stub and the one or more grounded capacitive stubs.

16. A method comprising:

forming a dielectric layer on a first metal layer having a first surface;

forming a pattern of a second metal layer on the dielectric layer to expose a dielectric window being part of the dielectric layer, the pattern having a radiating stub and one or more grounded capacitive stubs spaced apart from the radiating stub; and forming a first ground plate coupled to the one or more grounded capacitive stubs, the first ground plate being part of the second metal layer and coupled to ground.

17. The method of claim 16 wherein the one or more grounded capacitive stubs extend from a first edge of the first ground plate parallel with a side edge of the radiating stub.

18. The method of claim 16 further comprising:

forming a shortening leg having a first end coupled to a bottom of the radiating stub; and forming an extended feeding strip coupled to the side edge of the radiating stub spaced apart from the shortening leg; wherein the radiating stub, the shortening leg, and the extended feeding strip are coupled together to form an F shape.

19. The method of claim 18 wherein the shortening leg has a second end opposite the first end is coupled to the first ground plate.

20. The method of claim 16 further comprising:

forming a second ground plate spaced apart from the first ground plate, the second ground plate to couple to ground, and wherein the shortening leg has a second end opposite the first end is coupled to the second ground plate.

21. The method of claim 18 further comprising:

forming a feeding line coupled to the extended feeding strip.

22. The method of claim 21 wherein the feeding line is a grounded coplanar waveguide having a central strip spaced apart from the first ground plate and the second ground plate forming a pair of gaps.

23. The method of claim 22 further comprising:

forming a third ground plate on a second surface of the dielectric layer opposite the first surface, the third ground plate to couple to ground, the third ground plate under the central strip and the pair of gaps.

24. The method of claim 23 wherein the extended feeding strip is formed in a second metal layer on the second surface of the dielectric substrate opposite the first surface, and the feeding line is a micro-strip line coupled to the extended feeding strip and formed in the second metal layer on the second surface of the dielectric substrate.

25. The method of claim 24 further comprising:

forming a metal conductor within a via hole of the dielectric substrate coupled between the extended feeding strip and the radiating stub.

26. A system comprising:

a base-band processor to process base-band signals, the base-band processor generating a transmitting signal and processing a receiving signal;

a transceiver coupled to the base-band processor to process the transmitting signal and the receiving signal;

a switch coupled to the transceiver to switch between the transmitting signal and the receiving signal; and an antenna circuit coupled to the switch to transmit the transmitting signal and to receive the receiving signal, the antenna circuit comprising:

a dielectric substrate having a first surface, a radiating stub on the first surface of the dielectric substrate, and a first ground plate on the surface of the dielectric substrate to couple to ground, the first ground plate including one or more grounded capacitive stubs spaced apart from the radiating stub, the one or more grounded capacitive stubs to tune performance parameters.

27. The system of claim 26 wherein the one or more grounded capacitive stubs extend from a first edge of the first ground plate parallel with a side edge of the radiating stub.

28. The system of claim 1 wherein the antenna circuit further comprises:

a shortening leg having a first end coupled to a bottom of the radiating stub; and an extended feeding strip coupled to the side edge of the radiating stub spaced apart from the shortening leg; wherein the radiating stub, the shortening leg, and the extended feeding strip are coupled together to form an F shape.

29. The system of claim 28 wherein the shortening leg has a second end opposite the first end is coupled to the first ground plate.

30. The system of claim 26 wherein the antenna circuit further comprises:

a second ground plate spaced apart from the first ground plate, the second ground plate to couple to ground, and wherein the shortening leg has a second end opposite the first end is coupled to the second ground plate.

* * * * *